US008761408B2

(12) United States Patent
Yoneda et al.

(10) Patent No.: US 8,761,408 B2
(45) Date of Patent: Jun. 24, 2014

(54) SIGNAL PROCESSING APPARATUS AND SIGNAL PROCESSING METHOD

(75) Inventors: Michiaki Yoneda, Kanagawa (JP); Taro Nakagami, Kanagawa (JP)

(73) Assignee: Sony Corporation, Tokyo (JP)

( * ) Notice: Subject to any disclaimer, the term of this patent is extended or adjusted under 35 U.S.C. 154(b) by 525 days.

(21) Appl. No.: 12/783,906

(22) Filed: May 20, 2010

(65) Prior Publication Data

US 2010/0316226 A1 Dec. 16, 2010

(30) Foreign Application Priority Data

Jun. 12, 2009 (JP) ..... 2009-140968

(51) Int. Cl.
*H04R 3/02* (2006.01)

(52) U.S. Cl.
USPC ..... 381/59; 381/71.1; 381/71.14; 381/73.1; 381/94.1; 381/94.2; 381/94.3; 381/94.4; 381/94.5; 381/94.6; 381/94.7; 381/94.8; 381/94.9; 381/96; 381/98; 381/103; 381/104; 381/105; 381/106; 381/107; 381/108; 381/109; 700/94

(58) Field of Classification Search
USPC ..... 381/71.1, 71.14, 73.1, 94.1–94.9, 96
See application file for complete search history.

(56) References Cited

U.S. PATENT DOCUMENTS 4,180,706 A * 12/1979 Bakgaard ..... 381/96
4,969,195 A * 11/1990 Noro ..... 381/96
4,980,920 A * 12/1990 Noro et al. ..... 381/96
5,103,190 A * 4/1992 Noro ..... 330/298
5,729,611 A * 3/1998 Bonneville ..... 381/55
6,996,240 B1 * 2/2006 Sasaki ..... 381/58
8,300,872 B2 * 10/2012 Liitola et al. ..... 381/387
2003/0021427 A1 * 1/2003 Nakada et al. ..... 381/96

(Continued)

FOREIGN PATENT DOCUMENTS

JP 9-289699 11/1997
JP 2005027069 A * 1/2005

(Continued)

OTHER PUBLICATIONS

Klippel, The Mirror Filter, A New Basis for Reducing Nonlinear Distortion and Equalizing Response in Woofer Systems, AES, Sep. 1992.*

*Primary Examiner* — Davetta W Goins
*Assistant Examiner* — Kuassi Ganmavo
(74) *Attorney, Agent, or Firm* — Oblon, Spivak, McClelland, Maier & Neustadt, L.L.P.

(57) ABSTRACT

A signal processing apparatus includes: one or more detection means for detecting movement of a diaphragm of a speaker in correspondence with feedback methods that are different feedback methods; analog-to-digital conversion means for converting one or more detection signals acquired by the detection means into a digital form; feedback signal generating means for generating feedback signals corresponding to the feedback methods using the digital detection signals; synthesis means for combining an audio signal to be output as a driving signal of the speaker with the feedback signals; correction equalizer means for setting an equalizing characteristic to allow a sound reproduced by the speaker to have a target frequency characteristic by changing the digital audio signal; feedback operation setting means for setting feedback methods in which a feedback operation up to combining the audio signal with the feedback signal is performed and the feedback operation is not performed equalizing characteristic changing and setting means for changing the equalizing characteristic to be set by the correction equalizer means in accordance with a combination of the feedback methods.

12 Claims, 20 Drawing Sheets

(56) References Cited

U.S. PATENT DOCUMENTS

| | | | | |
|---|---|---|---|---|
| 2003/0072462 | A1* | 4/2003 | Hlibowicki | 381/96 |
| 2003/0194097 | A1* | 10/2003 | Ding | 381/96 |
| 2003/0210798 | A1* | 11/2003 | Ohyaba | 381/96 |
| 2005/0069153 | A1* | 3/2005 | Hall et al. | 381/103 |
| 2007/0076906 | A1* | 4/2007 | Takagi et al. | 381/118 |

FOREIGN PATENT DOCUMENTS

| | | | | |
|---|---|---|---|---|
| JP | 2005039325 | A | * | 2/2005 |
| JP | 2005323204 | A | * | 11/2005 |
| JP | 2007-121795 | | | 5/2007 |
| JP | 2008113102 | A | * | 5/2008 |
| JP | 2008-193421 | | | 8/2008 |

* cited by examiner

FIG.8

| OPERATION MODE | SPEED FEEDBACK-TYPE | ACCELERATION FEEDBACK-TYPE | EQUALIZER CORRECTION CHARACTERISTIC |
|---|---|---|---|
| MFB-OFF MODE | OFF | OFF | PASS (INEFFECTIVE) |
| FIRST MFB-ON MODE | ON | OFF | CHARACTERISTIC 1 |
| SECOND MFB-ON MODE | ON | ON | CHARACTERISTIC 2 |

FIG.9

| ITEM | | SPEED FEEDBACK-TYPE | ACCELERATION FEEDBACK-TYPE | EQUALIZER CORRECTION CHARACTERISTIC |
|---|---|---|---|---|
| MOVIE | | GAIN a1 | GAIN a2 | CHARACTERISTIC A |
| MUSIC | ROCK | GAIN b1 | GAIN b2 | CHARACTERISTIC B |
| | JAZZ | GAIN c1 | GAIN c2 | CHARACTERISTIC C |
| | CLASSIC | GAIN d1 | GAIN d2 | CHARACTERISTIC D |

SIGNAL PROCESSING APPARATUS AND SIGNAL PROCESSING METHOD

BACKGROUND OF THE INVENTION

1. Field of the Invention

The present invention relates to a signal processing apparatus that performs signal processing for an audio signal in accordance with a predetermined purpose and a method thereof.

2. Description of the Related Art

In the acoustic field, MFB (Motional FeedBack) is known. MFB is a technology for controlling, for example, the diaphragm of a speaker unit and an input audio signal to have the same movement by detecting the movement of the diaphragm of the speaker unit and applying negative feedback to the input audio signal. Accordingly, vibration, for example, near a low band resonant frequency f0 is damped, and thereby undesired influences on the low frequency-band such as so-called "boomy base" are aurally suppressed.

A related art has been disclosed in JP-A-9-289699.

SUMMARY OF THE INVENTION

The MFB technologies until now have been used only for enhancement of the quality of the sound reproduced from a speaker unit. There is a need for providing a user, for example, as a listener, with more useful audio-listening environments by giving new value-added functions by the MFB technologies.

According to an embodiment of the present invention, there is provided a signal processing apparatus including: one or more detection means disposed for detecting movement of a diaphragm of a speaker in correspondence with first to n-th feedback methods that are different feedback methods; analog-to-digital conversion means for converting one or more detection signals of an analog form acquired by the detection means into a digital form; feedback signal generating means for generating feedback signals corresponding to the first to n-th feedback methods by using the detection signals of the digital form acquired by the analog-to-digital conversion means; synthesis means for combining an audio signal of the digital form to be output as a driving signal of the speaker with the feedback signals; correction equalizer means for setting an equalizing characteristic to allow a sound reproduced by the speaker to have a target frequency characteristic by changing a frequency characteristic of the audio signal of the digital form; feedback operation setting means for setting a feedback method in which a feedback operation up to combining the audio signal with the feedback signal, which is performed by the synthesis means, is performed and a feedback method in which the feedback operation is not performed, from among the first to n-th feedback methods; and equalizing characteristic changing and setting means for changing the equalizing characteristic to be set by the correction equalizer means in accordance with a combination of the feedback method in which the feedback operation set by the feedback operation setting means is performed and the feedback method in which the feedback operation is not performed.

Under the above-described configuration, as an MFB (Motional FeedBack) signal processing system, at least a system used for generating a feedback signal based on a detection signal and applying the feedback signal to an input audio signal as feedback is configured based on digital signal processing (digital circuit). In addition, as an embodiment of the present invention, focusing on easy implementation of changing internal settings, changing parameters, and the like based on the digital signal processing, a combination of feedback methods to be turned on out of a plurality of feedback methods is configured to be able to be changed. Furthermore, in accordance with the changing of the combination of feedback methods to be turned on, the equalizing characteristic used for correcting the frequency characteristic of the sound reproduced in the speaker is also changed.

Thus, according to the embodiment of the present invention, a reproduced sound having a different hearing pattern can be selected based on whether or not the MFB is applied, for example, by changing the combination of the feedback methods to be turned on. In addition, accordingly, the frequency characteristic of the reproduced sound is appropriately corrected in accordance with the combination of the feedback methods to be turned on. In other words, by combining the feedback methods to be turned on, a frequency characteristic that is optimal can be acquired, and thereby the sound quality of the reproduced sound is maintained to be excellent.

As described above, according to the embodiment of the present invention, a new audio hearing method, in which a difference in the reproduced sound heard differently in accordance with a combination of the feedback methods can be selected while typically maintaining the excellent sound quality of the reproduced sound, can be proposed.

BRIEF DESCRIPTION OF THE DRAWINGS

FIG. 8 is a diagram representing an example of the contents of a mode setting table.

FIG. 9 is a diagram representing an example of the contents of a gain-to-correction characteristic table.

FIG. 17 is a diagram showing the frequency characteristic of sound reproduced by the speaker unit in a case where the MFB signal processing system shown in FIG. 15 is turned on.

DESCRIPTION OF THE PREFERRED EMBODIMENTS

Hereinafter, modes for implementing the present invention (hereinafter, referred to as embodiments) will be described in the following order.

1. Configuration Example of Analog MFB
2. Digital MFB: Basic Configuration
3. Digital MFB: Embodiments
   3-1. Configuration Example
   3-2. Setting Correction Characteristic of Equalizer
   3-3. Application Example (First Example)
   3-4. Application Example (Second Example)
4. Digital MFB: Modified Example
5. Adjustment of Feedback Gain
   5-1. Adjustment in Analog Circuit
   5-2. Adjustment in Digital Circuit
6. Adjustment of Correction Characteristic of Equalizer
   6-1. Adjustment in Analog Circuit
   6-2. Adjustment in Digital Circuit 1. Configuration Example of Analog MFB MFB (Motional FeedBack) is technology for detecting the vibration of a speaker unit and applying negative feedback to an audio signal to be supplied to the speaker unit. Until now, efforts have been made for achieving enhancement of the aural sound quality by controlling a speaker unit to be more accurately vibrated in accordance with an input audio signal by using the MFB. Described in more detail, unnecessary vibration of a diaphragm of the speaker unit, for example, near a low frequency-band resonant frequency f0 is suppressed. Accordingly, sound for which an undesirable influence on the low frequency-band, so-called "boomy base" is suppressed can be acquired.

Figure 15:
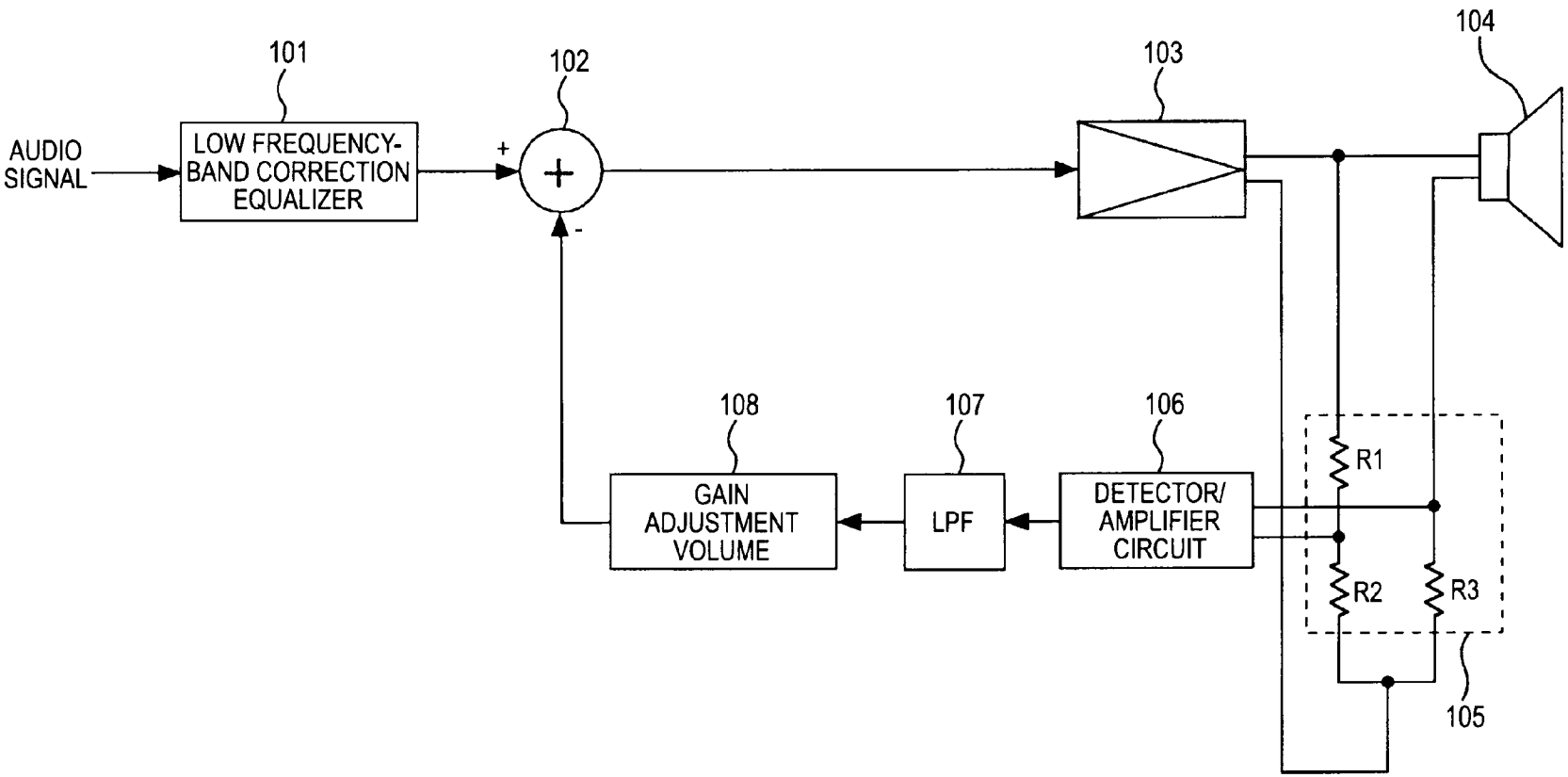
FIG. 15 is a diagram showing a configuration example of an analog MFB signal processing system.

FIG. 15 shows an example for a case where a signal processing system (MFB signal processing system) corresponding to the MFB is configured by analog circuits. As shown in this figure, first, low frequency-band compensation, to be described later, is performed for an analog audio signal by a low frequency-band correction equalizer 101, and the compensated audio signal is output to a synthesizer 102.

The synthesizer 102 receives the audio signal transmitted from the low frequency-band correction equalizer 101 and a signal transmitted from a gain adjustment volume 108 as input. The signal transmitted from the gain adjustment volume 108, as will be described later, is a feedback signal of the MFB that is acquired based on detection of the movement of a speaker unit 104. The synthesizer 102 combines the audio signal transmitted from the low frequency-band correction equalizer 101 with an inverted feedback signal. In other words, an audio signal is output by applying negative feedback to the audio signal by using a feedback signal.

The audio signal output from the synthesizer 102 is amplified by a power amplifier 103 and is output to the speaker unit 104. Accordingly, sound is reproduced in the speaker unit 104 in accordance with the audio signal.

A bridge circuit 105 that is configured by resistors R1, R2, and R3 is disposed in a driving signal line extending from the power amplifier 103 to the speaker unit 104 in accordance with the MFB, and the output of the bridge circuit 105 configured to be input to a detector/amplifier circuit 106.

The detector/amplifier circuit 106 amplifies a signal that is acquired by detecting a counter electromotive force generated in a voice coil of the speaker unit 104 and outputs the amplified signal to a low pass filter (LPF) 107. Here, the counter electromotive force detected by the bridge circuit 105 corresponds to detection of the speed of the diaphragm according to the movement of the diaphragm of the speaker unit 104.

The LPF 107 eliminates a frequency band, which is unnecessary for the MFB control, from an input signal and outputs the input signal to the gain adjustment volume 108.

The gain adjustment volume 108, for example, applies a gain (feedback gain) according to a gain value set in advance for the input signal and outputs a resultant signal to the synthesizer 102 as a feedback signal.

Figure 16:
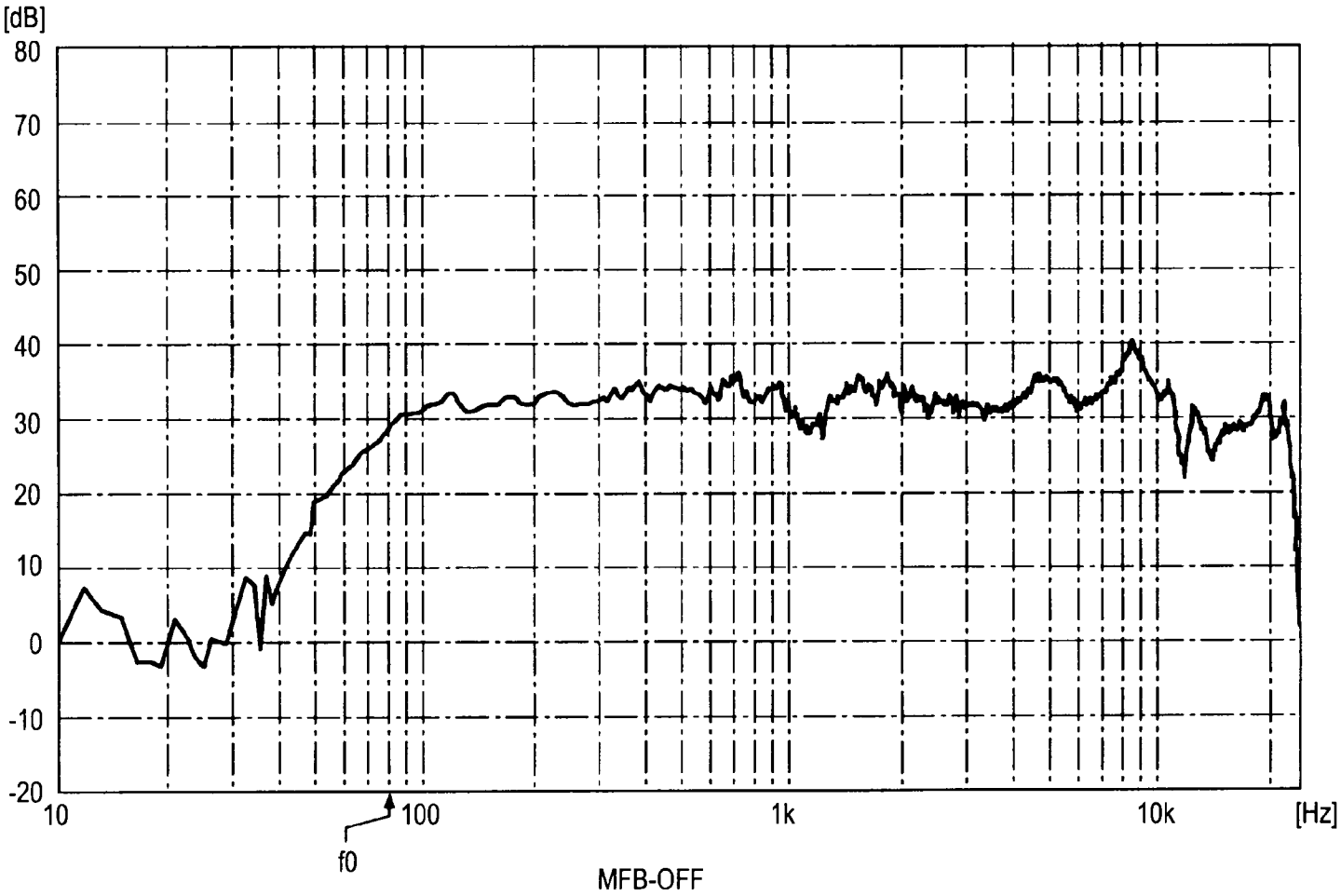
FIG. 16 is a diagram showing the frequency characteristic of sound reproduced by the speaker unit in a case where the MFB signal processing system shown in FIG. 15 is turned off.
Figure 17:
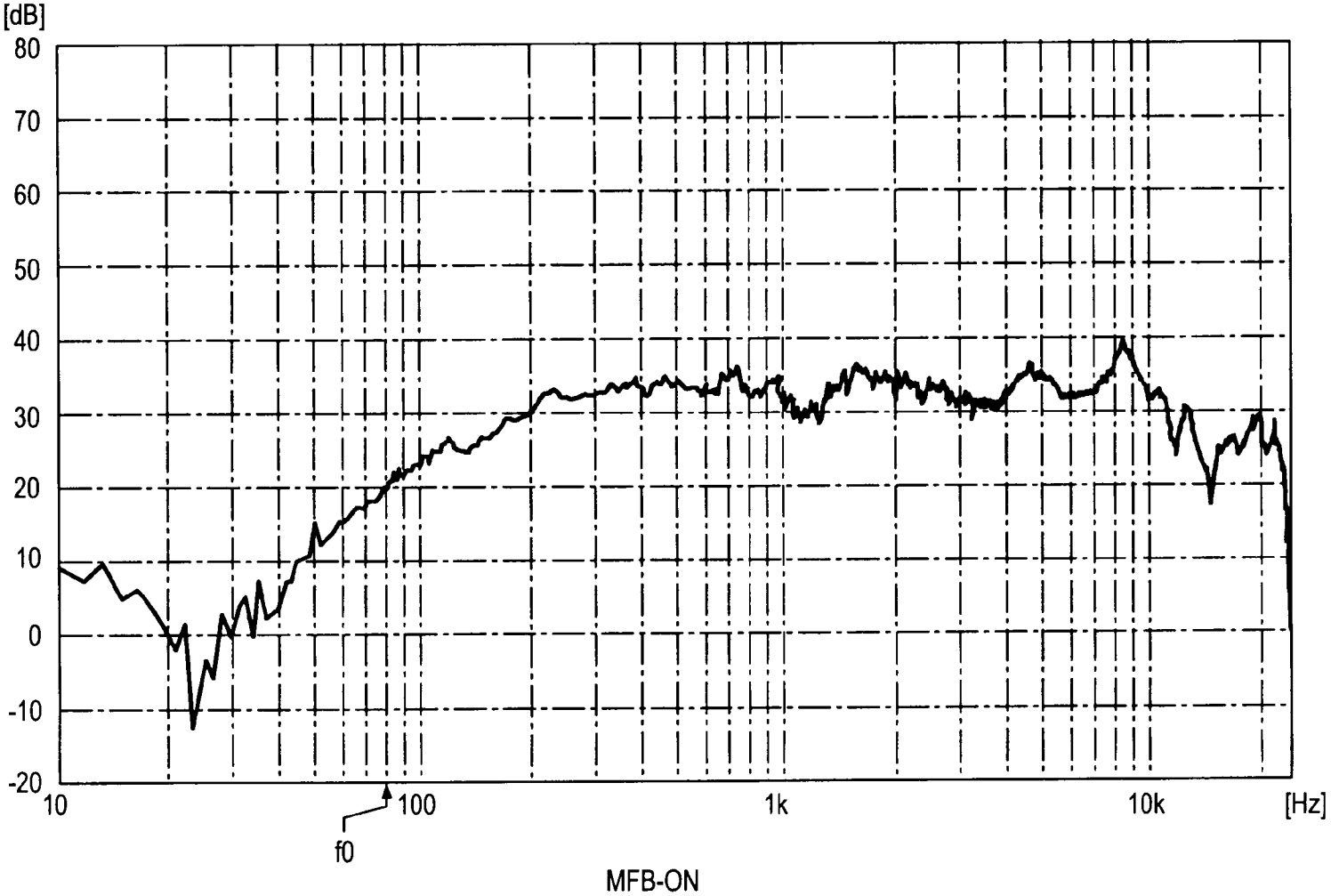
Figure 18:
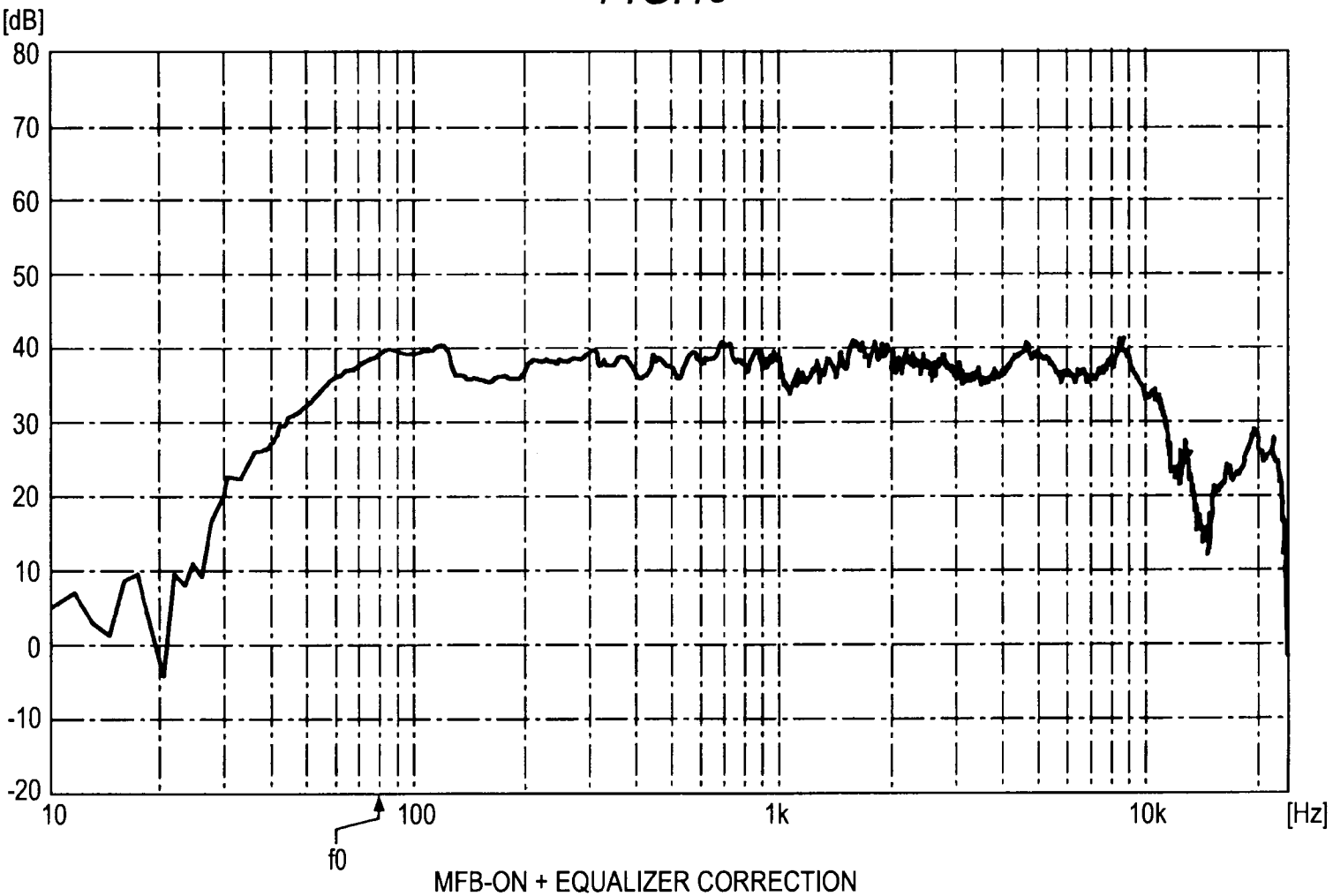
FIG. 18 is a diagram showing the frequency characteristic acquired by correcting the characteristic shown in FIG. 17.

Here, FIGS. 16 to 18 show the frequency characteristics of the speaker unit 107 that are measured under the configuration of the analog MFB shown in FIG. 15. In addition, the low band resonant frequency f0 of the speaker unit 107 is assumed to be 80 Hz in this case.

FIG. 16 shows the frequency characteristic for a case where the MFB is turned off so as not to be operated. In other words, the characteristic is acquired in a case where an audio signal is directly input to the power amplifier 103 and amplified so as to drive the speaker unit 104 without performing correction by using the low frequency-band correction equalizer 101 and applying negative feedback by using the synthesizer 102.

Next, FIG. 17 shows a characteristic of the speaker unit 107 for a case where the MFB is in operation (turned on). However, the shown characteristic is a characteristic for the state in which the low frequency-band is not compensated by the low frequency-band correction equalizer 101.

As is apparent upon comparing FIGS. 16 and 17 with each other, when the MFB is turned on, power near the low band resonant frequency f0 is suppressed, compared to when the MFB is turned off. This indicates that the vibration at the low band resonant frequency f0 is effectively damped by applying the MFB.

However, the above-described frequency characteristic shown in FIG. 17 can be perceived as a state in which the power of the low frequency band is attenuated, for example, in a case where a flat frequency characteristic is desired. Thus, in the MFB configuration shown in FIG. 15, the low frequency-band correction equalizer 101 is disposed in a stage prior to the synthesizer 102. In other words, the low frequency band of the input audio signal that is attenuated by the MFB is corrected (frequency-band compensated) in advance by the low frequency-band correction equalizer 101.

FIG. 18 shows the frequency characteristic acquired in a case where the MFB is turned on and the frequency-band compensation is performed by the low frequency-band correction equalizer 101 under the configuration shown in FIG. 15.

In the frequency characteristic shown in FIG. 18, the power of the low frequency-band side is increased, compared to that shown in FIG. 17. Accordingly, on the whole, a characteristic that is flatter (smoother) than that shown in FIG. 17 can be acquired. In other words, the frequency characteristic is enhanced by the frequency band compensation performed by the low frequency-band correction equalizer 101.

For example, the equalizing characteristic (correction characteristic) of the low frequency-band correction equalizer 101 shown in FIG. 15 is set as follows.

First, the frequency characteristic of the speaker unit 107 is measured in the state in which the MFB is turned on after an input audio signal passes through the low frequency-band correction equalizer 101. Next, the amount of correction to allow the measured frequency characteristic to be a target frequency characteristic such as a flat frequency characteristic is calculated. In other words, a frequency band to be changed and a gain that may be needed for the frequency band acquired. Then, the equalizing characteristic is set, for example, manually for the low frequency-band correction equalizer 101 such that the above-described amount of correction is acquired.

In addition, under the analog configuration, the setting of a gain value for the gain adjustment volume 108, is performed, for example, manually.

2. Digital MFB: Basic Configuration

The above-described configuration of the MFB signal processing system shown in FIG. 15 is configured by analog circuits. On the other hand, in this embodiment, the MFB signal processing system is configured by digital circuits.

Figure 1:
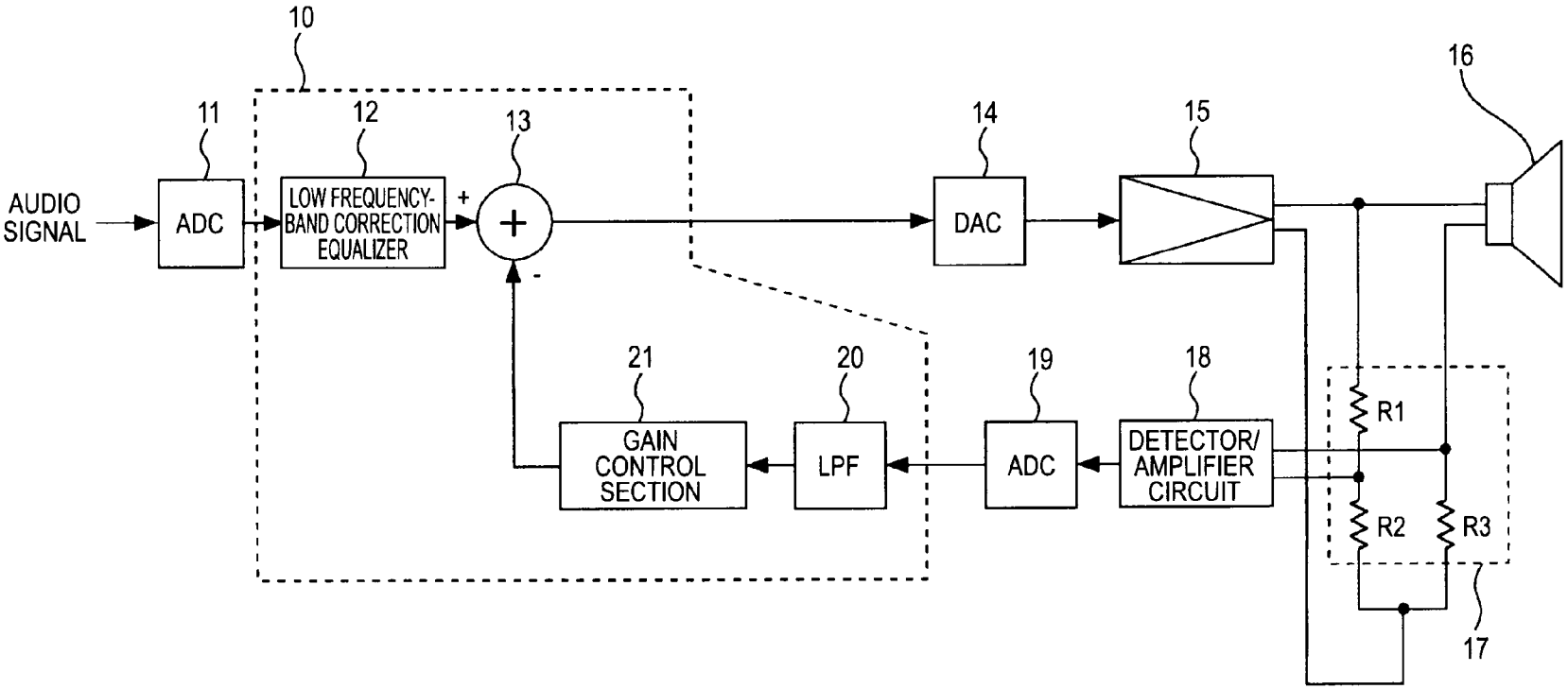
FIG. 1 is a diagram showing an example of the basic configuration of an MFB signal processing system configured by digital circuits.

First, FIG. 1 shows an example of the basic configuration that can be considered as a digital MFB signal processing system. In addition, the configuration shown in this figure corresponds to one channel amongst a plurality of channels forming multiple channels in a case where an audio sound source that is the source of an audio signal has a multiple-channel configuration.

As shown in FIG. 1, first, by inputting an analog audio signal (input audio signal) to an ADC (A/D converter) 11, the analog audio signal is converted into a digital audio signal and is input to a digital signal processing unit 10.

The digital signal processing unit 10 of this case, for example, is configured by a low frequency-band correction equalizer 12, a synthesizer 13, an LPF 20, and a gain control section 21. For example, the digital signal processing unit 10 may be configured by a DSP (Digital Signal Processor). Accordingly, the signal processing of each of the low frequency-band correction equalizer 12, the synthesizer 13, the LPF 20, and the gain control section 21 of the digital signal processing unit 10 may be implemented by a program such as an instruction or the like that is executed by the DSP.

The digital audio signal input to the digital signal processing unit 10 is output to the synthesizer 13 through the low frequency-band correction equalizer 12. The synthesizer 13 inverts a feedback signal output from the gain control section 21 and combines the inverted feedback signal with the audio signal output from the low frequency-band correction equalizer 12. Accordingly, negative feedback, which is in accordance with detection of a counter electromotive force generated in a voice coil, can be applied to the audio signal.

The digital audio signal output from the synthesizer 13 is input to a DAC (D/A converter) 14 as the output of the digital signal processing unit 10.

The DAC 14 converts the input digital audio signal into the form of an analog signal and outputs the analog audio signal to the power amplifier 15.

The power amplifier 15 amplifies the analog audio signal and supplies the amplified analog audio signal to a speaker unit (speaker) 16 as a speaker driving signal. The speaker unit 16 that is driven in accordance with the speaker driving signal reproduces sound according to the input audio signal.

Several methods of detecting the movement of the diaphragm of the speaker unit 16 in the MFB have been known. Here, a bridge detection method is used. According to the bridge detection method, a bridge circuit 17, as shown in the figure, is disposed in a line for the speaker driving signal that is disposed between the power amplifier 15 and the speaker unit 16. This bridge circuit 17, for example, as shown in the figure, includes resistors R1, R2, and R3 and is formed by performing bridge connection for the resistors as shown in the figure.

The detector/amplifier circuit 18 detects the counter electromotive force generated in the voice coil of the speaker unit 16 through which the speaker driving signal flows by detecting an electric potential between a connection point of the resistors R1 and R2 of the bridge circuit 17 and a connection point of the speaker unit 16 and the resistor R3. The amount of the counter electromotive force detected here corresponds to the vibration, that is, the movement, of the diaphragm of the speaker unit 16. In particular, the detected amount of the counter electromotive force corresponds to the movement of the diaphragm near the low band resonant frequency f0.

The detector/amplifier circuit 18 of this case amplifies a detection signal and then outputs the amplified detection signal to an ADC (A/D converter) 19.

The ADC 19 converts the analog detection signal output from the detector/amplifier circuit 18 into a digital signal and outputs the digital signal to the digital signal processing unit 10.

The digital detection signal output from the ADC 19 is input to a LPF (Low Pass Filter) 20 of the digital signal processing unit 10. The LPF 20, for example, is formed by an FIR filter or the like. The LPF 20 allows a frequency band signal component corresponding to a frequency that is equal to or lower than a predetermined frequency, and thereby eliminating a high-frequency component that is not needed for the MFB control. The signal passing through the LPF 20 is input to the gain control section 21.

The gain control section 21, for example, sets a gain (feedback gain) of the input signal, for example, corresponding to the amount of feedback and outputs a resultant signal to the synthesizer 13 as a feedback signal.

The signal that is acquired by being detected according to the bridge detection method by the bridge circuit 17 directly represents the speed of the movement of the diaphragm. Then, the feedback signal that is acquired by limiting the frequency band of the detection signal through the LPF 20 is generated in accordance with the detection of the speed. In other words, the MFB method (feedback method: feedback control method) shown in FIG. 1 corresponds to a speed-feedback type.

The synthesizer 13 inverts the phase of the feedback signal and combines the feedback signal with the audio signal output from the low frequency-band correction equalizer 12. Accordingly, a negative feedback operation can be acquired as the speed-feedback type.

The output of the synthesizer 13 of this case is input to the DAC (D/A converter) 14 as an output audio signal of the digital signal processing unit 10 and is converted into an analog audio signal.

The power amplifier 15 amplifies the analog audio signal output from the DAC 14 and supplies the amplified audio signal to the voice coil of the speaker unit 16 as the speaker driving signal.

By supplying the speaker driving signal as described above, sound corresponding to the input audio signal is reproduced by the speaker unit 16. By applying speed feedback to the audio signal that is based on the speaker driving signal, the movement of the diaphragm of the speaker unit 16 corresponding to a frequency, for example, near the low band resonant frequency f0 is damped. In other words, the MFB can be applied. Accordingly, for example, the sound reproduced by the speaker unit 16 is enhanced.

In addition, as described above, the frequency characteristic in which the power near the low band resonant frequency f0 tends to decrease is acquired by applying only the MFB. The correction or compensation for the frequency characteristic is performed by the low frequency-band correction equalizer 12 of the digital signal processing unit 10. In other words, an equalizing characteristic (correction characteristic) for correcting the frequency characteristic acquired at a time when only the MFB is applied to be a target frequency characteristic (for example, a flat characteristic) is given to the low frequency-band correction equalizer 12. Accordingly, the audio signal passing through the low frequency-band correction equalizer 12 is equalized such that the power of a frequency band attenuated by applying the MFB is raised in advance. As a result, the sound reproduced by the speaker unit 16 that has a desired frequency characteristic can be acquired regardless of the applying of the MFB.

3. Digital MFB: Embodiment 3-1. Configuration Example

As shown in FIG. 1, by configuring the MFB signal processing system by using digital circuits, a change in or switching between the characteristics or the operation modes can be made without changing the constants of physical components, replacing the physical components, or the like. This can be implemented in an easy manner by describing necessary parameters and constants to be changed for being set in a program to be given to the DSP or the like, for example in a case where the digital signal processing system is configured by the DSP. For example, it is very difficult to appropriately change the settings of such parameters and constants automatically in accordance with switching between the characteristics or the operation modes in a case where the MFB signal processing system is configured by analog circuits as shown in FIG. 15.

The original purpose of the MFB is to enhance the fidelity of sound reproduction and the sound quality by controlling the vibration or the movement of the diaphragm of the speaker unit to maintain fidelity to the input audio signal as possibly as can be.

As this embodiment, a configuration in which the above-described advantages, which can be acquired by configuring the MFB by using digital circuits, are more effectively utilized in addition to achievement of the enhancement of the fidelity and the sound quality as the original purpose of the MFB is proposed.

Figure 2:
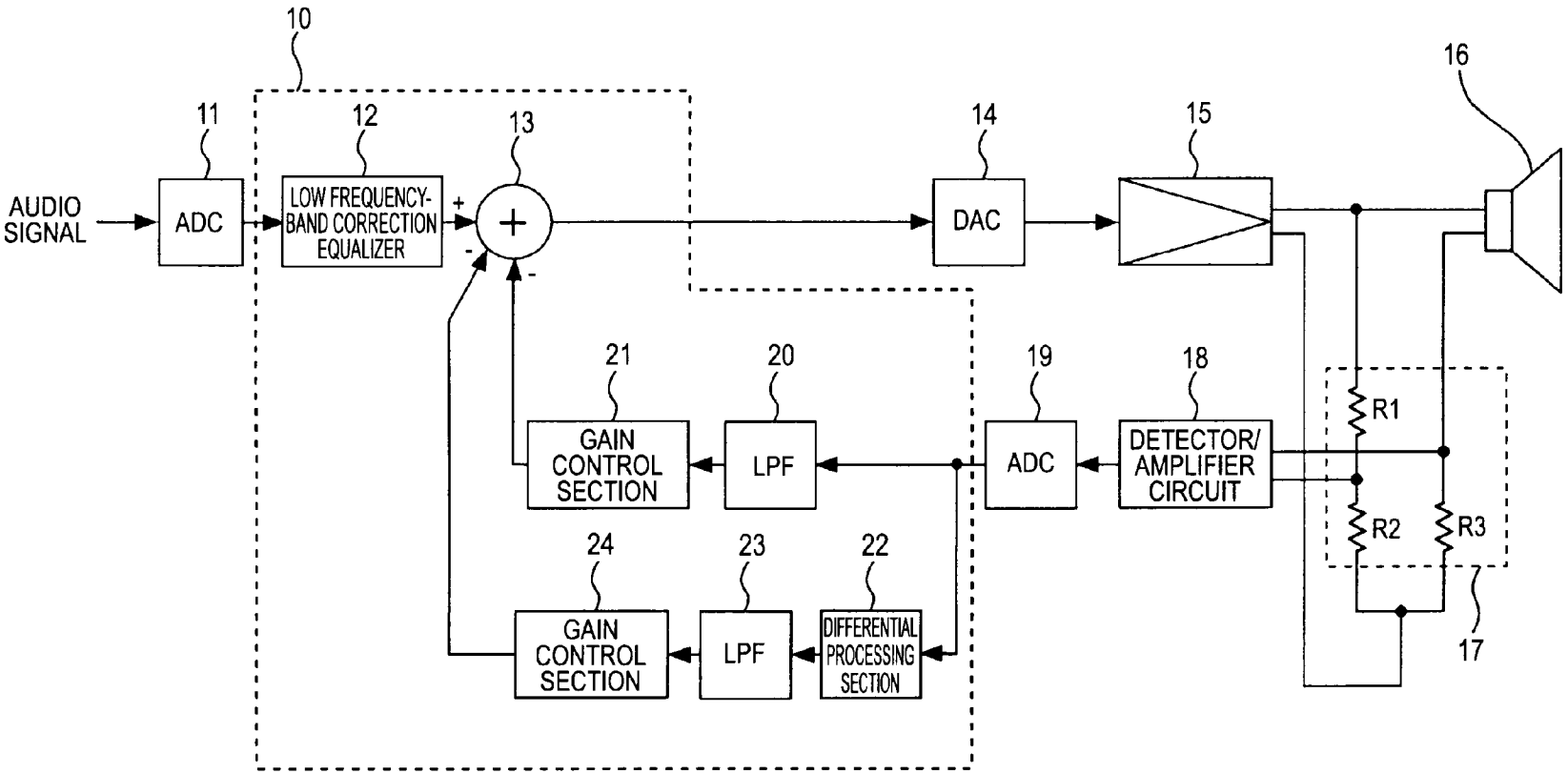
FIG. 2 is a diagram showing a configuration example of an MFB signal processing system, which is configured by digital circuits, according to this embodiment.

FIG. 2 shows a configuration example of an MFB signal processing system according to this embodiment. The MFB signal processing system as the embodiment shown in the figure also includes a configuration in which digital circuits are used. Thus, a same reference sign is assigned to each same portion as that shown in FIG. 1, and the description thereof is omitted here.

In a digital signal processing unit 10 shown in FIG. 2, a differential processing section 22, an LPF 23, and a gain control section 24 are added to the configuration shown in FIG. 1. To the differential processing section 22, an audio signal of the digital form that is input to the LPF 20 from the ADC 19 is branched so as to be input.

The differential processing section 22 performs a differential calculation process for the input audio signal and outputs a resultant signal to the LPF 23. As described above, a signal that is acquired by the bridge circuit 17 by detecting the counter electromotive force can be regarded as a signal indicating the speed of the movement of the diaphragm. The differential processing section 22 calculates differential of a detection signal corresponding to the above-described speed. In other words, a signal (differential value) acquired by the differential processing section 22 corresponds to calculating acceleration of the movement of the diaphragm and is a detection signal corresponding to the acceleration. The LPF 23 eliminates a high frequency band component that is unnecessary for acceleration feedback control from the input differential signal, that is, the detection signal of the acceleration and outputs a resultant signal to the gain control section 24. The gain control section 24 applies a necessary feedback gain to the input signal and outputs a resultant signal to a synthesizer 13 as a feedback signal corresponding to the acceleration feedback type.

The synthesizer 13 of this case can combine the audio signal output from the low frequency-band correction equalizer 12 with both a feedback signal corresponding to the speed feedback type, which is output from the gain control section 21, and a feedback signal corresponding to the acceleration type, which is output from the gain control section 24 by applying negative feedback. In other words, in the configuration shown in FIG. 2, control combining the speed feedback type and the acceleration feedback type is configured to be performed as the MFB.

The MFB signal processing system of the speed feedback type can be regarded to be formed by including a signal processing system disposed on the side of the LPF 20 and the gain control section 21 in a closed loop system formed from output of an audio signal from the synthesizer 13 to feedback of a feedback signal to the synthesizer 13.

On the other hand, the MFB signal processing system of the acceleration feedback type can be regarded to be formed by including a signal processing system disposed on the side of the differential processing section 22, the LPF 23, and the gain control section 24 in the above-described closed loop system.

In the configuration shown in FIG. 2, as described above, the digital signal processing unit 10, which is a digital signal processing system, includes a system of the LPF 20 and the gain control section 21 corresponding to the speed feedback type and a system of the differential processing section 22, the LPF 23, and the gain control section 24 corresponding to the acceleration feedback type. This indicates that switching among an operation mode that depends only on the speed feedback type, an operation mode that depends only on the acceleration feedback type, and an operation mode in which both the speed feedback type and the acceleration feedback type are effective can be performed, for example, as one type of the switching between the operation modes. As described above, such switching between the operation modes can be implemented in an easy manner for a digital circuit.

In particular, in a case where the operation that depends only on the speed feedback type is performed, signal processing corresponding to the LPF 20 and the gain control section 21 is performed without performing signal processing corresponding to the differential processing section 22, the LPF 23, and the gain control section 24. In addition, in such a case, the synthesizer 13 may invert the phase of a feedback signal output from the gain control section 21 and combine an audio signal output from the low frequency-band correction equalizer 12 only with the phase-inverted feedback signal.

On the other hand, in a case where the operation that depends only on the acceleration feedback type is performed, the signal processing corresponding to the differential processing section 22, the LPF 23, and the gain control section 24 is performed, and the signal processing corresponding to the LPF 20 and the gain control section 21 is not performed. In such a case, the synthesizer 13 inverts the phase of a feedback signal output from the gain control section 24 and combines the audio signal output from the low frequency-band correction equalizer 12 only with the phased-inverted feedback signal.

Furthermore, in a case where both the speed feedback type and the acceleration feedback type are operated, both the signal processing corresponding to the LPF 20 and the gain control section 21 and the signal processing corresponding to the differential processing section 22, the LPF 23, and the gain control section 24 are performed. In such a case, the synthesizer 13 inverts the phases of two feedback signals output from the gain control section 21 and the gain control section 24 and combines the audio signal output from the low frequency-band correction equalizer 12 with the two phase-inverted feedback signals.

Here, as the above-described switching of the operation modes of the MFB, first, the MFB is configured to be turned on or off. In addition, in the case of an operation mode (MFB-Off mode) in which the MFB is turned off in FIG. 2, the input audio signal may be converted into a digital form by the ADC 11, input to the digital signal processing unit 10, and output to the DAC 14 without performing digital signal processing relating to the MFB (other necessary digital signal processing may be appropriately performed).

In addition, in the case where the MFB is turned on, it is assumed that switching between an operation mode (first MFB-On mode) in which only the speed feedback type is operated and an operation mode (second MFB-On mode) in which both the speed feedback type and the acceleration feedback type are operated is performed. However, in description here, for the convenience of description, it is assumed each of gain values set in the gain control sections 21 and 24 is set to one value that is selected as an optimal value.

As one representative practical device having the configuration shown in FIG. 2, there is an active speaker or the like.

3-2. Setting Correction Characteristics of Equalizer

Under the configuration shown in FIG. 2, the low frequency-band correction equalizer 12 is configured by a digital circuit such as an FIR (Finite Impulse Response) filter or an IIR (Infinite Impulse Response) filter. Accordingly, setting of the correction characteristics can be changed in an easy manner. Thus, on the premise that switching of the above-described MFB operation modes is performed, an example of the setting of the correction characteristics of the low frequency-band correction equalizer 12 will be described.

Figure 3:
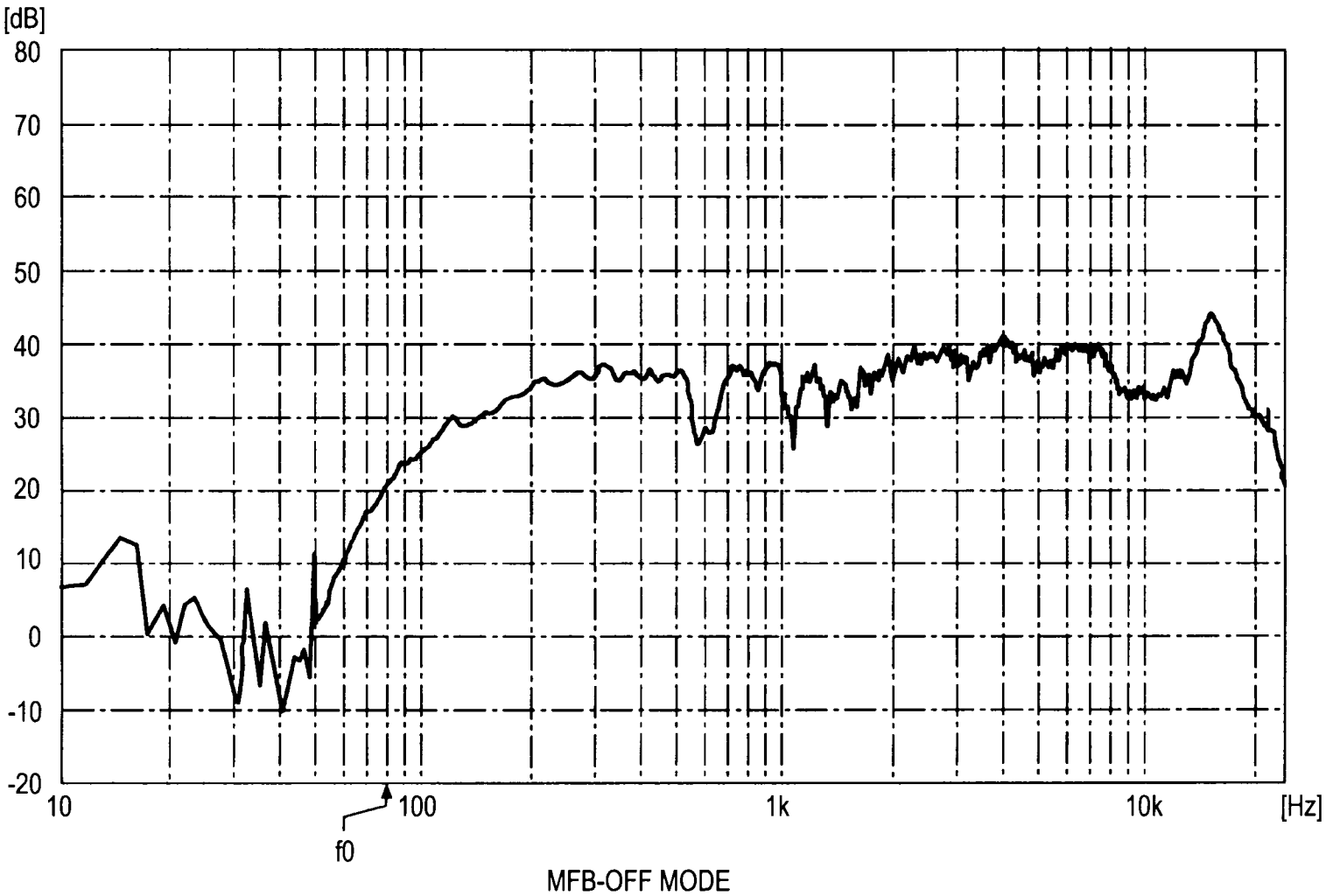
FIG. 3 is a diagram representing the frequency characteristic of sound reproduced by a speaker unit in an MFB-Off mode.

First, FIG. 3 represents the frequency characteristic of the speaker unit 16 in the case of the MFB-Off mode in which any of the speed feedback-type MFB and the acceleration feedback-type MFB is turned off in the MFB signal processing system shown in FIG. 2.

Figure 4:
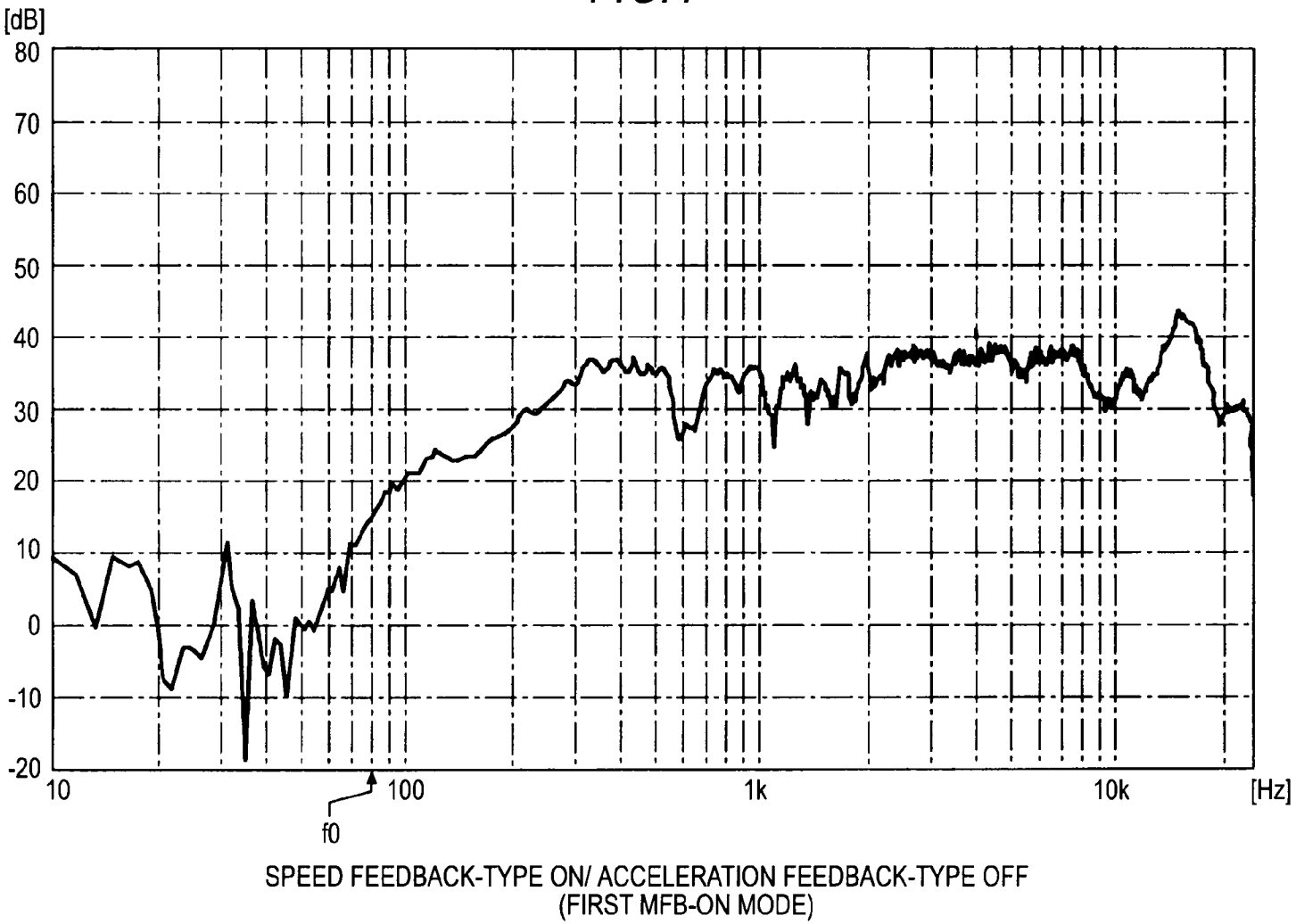
FIG. 4 is a diagram representing the frequency characteristic of sound reproduced by the speaker unit in a first MFB-On mode.

In addition, FIG. 4 represents the frequency characteristic of the speaker unit 16 in the case of the first MFB-On mode in which the speed feedback-type MFB is turned on and the acceleration feedback-type MFB is turned off in the MFB signal processing system shown in FIG. 2. However, the frequency band correction is not applied to the input audio signal by the low frequency-band correction equalizer 12.

Figure 5:
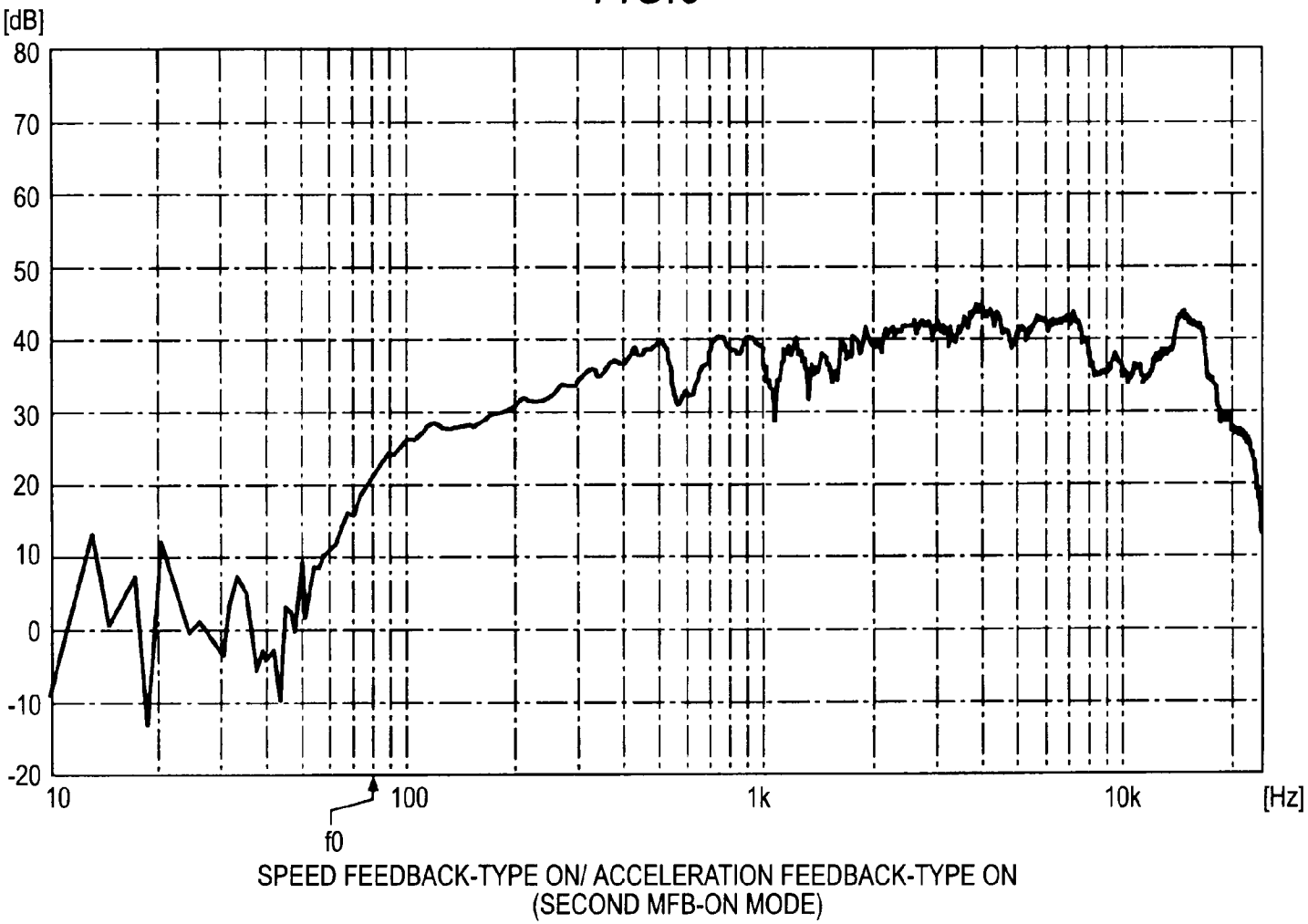
FIG. 5 is a diagram representing the frequency characteristic of sound reproduced by the speaker unit in a second MFB-On mode.

FIG. 5 represents the frequency characteristic of the speaker unit 16 in the case of the second MFB-On mode in which both the speed feedback-type MFB and the acceleration feedback-type MFB are turned on in the MFB signal processing system shown in FIG. 2. In the case shown in the figure, similarly to the case shown in FIG. 4, the frequency band correction is not applied to the input audio signal by the low frequency-band correction equalizer 12.

As can be noticed from the figures, in any of the first MFB-On mode shown in FIG. 4 and the second MFB-On mode shown in FIG. 5, power near the low band resonant frequency f0 is decreased, compared to that in the MFB-Off mode shown in FIG. 3. In other words, in any of the first MFB-On mode and the second MFB-On mode, the diaphragm of the speaker unit appears to be effectively braked by the feedback control as the MFB, and this becomes the base of enhancement of the reproduced sound.

However, it can be noticed by comparing the characteristic of the first MFB-On mode shown in FIG. 4 and the characteristic of the second MFB-On mode shown in FIG. 5, that the characteristics thereof are different from each other, although each of the first and second MFB-On modes is one of the MFB-On modes. For example, the power near the low band resonant frequency f0 tends to be stronger in the second MFB-On mode shown in FIG. 5 than the first MFB-On mode shown in FIG. 4. Such a difference depends on a difference in the conditions for feedback control in the first MFB-On mode and the second MFB-On mode.

Next, as the characteristics of the low frequency-band correction equalizer 12 of this case, two correction characteristics of the equalizer are determined in correspondence with the characteristic shown in FIG. 4 corresponding to the first MFB-On mode and the characteristic shown in FIG. 5 corresponding to second MFB-On mode such that both the characteristics become the target frequency characteristic.

Here, the target frequency characteristic is assumed to be a flat (smooth) characteristic. In other words, a flat characteristic is configured to be finally acquired as the frequency characteristic of the sound reproduced by the speaker unit 16 in any operation mode of the first MFB-On mode and the second MFB-On mode.

In this case, the frequency characteristics of the first MFB-On mode and the second MFB-On mode are different from each other as shown in FIGS. 4 and 5. Accordingly, in order to acquire the flat frequency characteristic of the speaker unit 16 in both the first MFB-On mode and the second MFB-On mode, different correction characteristics are set for the first MFB-On mode and the second MFB-On mode. In other words, in correspondence with the first MFB-On mode, a target frequency, of which the characteristic is to be changed, to allow the measured frequency characteristic as shown in FIG. 4 to be flat and parameters such as gain to be applied for the target frequency, of which the characteristic is to be changed, are acquired, and the correction characteristic is determined based on the parameters. Similarly, in correspondence with the second MFB-On mode, a target frequency, of which the characteristic is to be changed, to allow the measured frequency characteristic as shown in FIG. 5 to be flat and parameters such as gain to be applied for the target frequency, of which the characteristic is to be changed, are acquired, and the correction characteristic is determined based on the parameters.

Then, in the middle of the operation of the actual MFB signal processing system, first, when the first MFB-On mode is set as the operation mode, the parameters of the low frequency-band correction equalizer 12 are set such that the correction characteristic corresponding to the first MFB-On mode is set. Similarly, when the second MFB-On mode is set, the parameters of the low frequency-band correction equalizer are set such that the correction characteristic corresponding to the second MFB-On mode is set.

Figure 6:
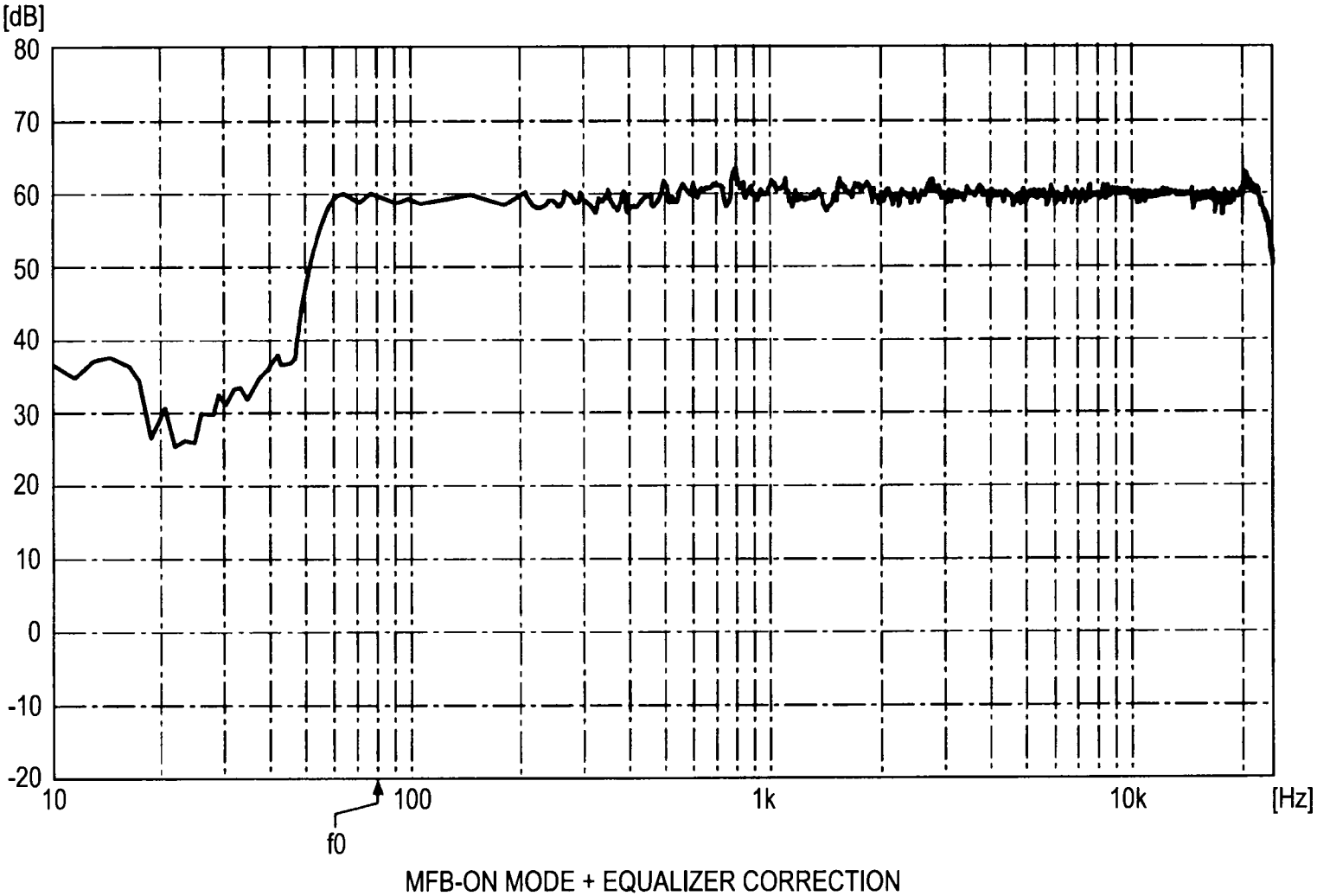
FIG. 6 is a diagram representing the frequency characteristic of sound reproduced by the speaker unit in a case where equalizer correction is performed in an MFB-On mode.

Accordingly, even when any one of the first MFB-On mode and the second MFB-On mode is set, for example, as shown in FIG. 6, the flat characteristic acquired by correcting the power of the low frequency-band to be raised can be acquired as the frequency characteristic of the speaker unit 16.

On the other hand, when the operation mode is the MFB-Off mode, an input audio signal is set so as to pass through the low frequency-band correction equalizer 12.

3-3. Application Example (First Example)

However, even when both the frequency characteristics for the first MFB-On mode and the second MFB-On mode are corrected to the flat frequency characteristic as described above, the actual sound patterns reproduced by the speaker unit 16 are clearly different from each other in the first MFB-On mode and the second MFB-On mode. The present inventors actually check such a phenomenon.

As one example, such a result is due to different feedback control conditions of the first MFB-On mode and the second MFB-On mode. Thus, although the measured frequency characteristics are corrected to be the same, there is a difference between the braking states of the diaphragm of the actual speaker unit 16 in the first MFB-On mode and the second MFB-On mode.

Figure 7A:
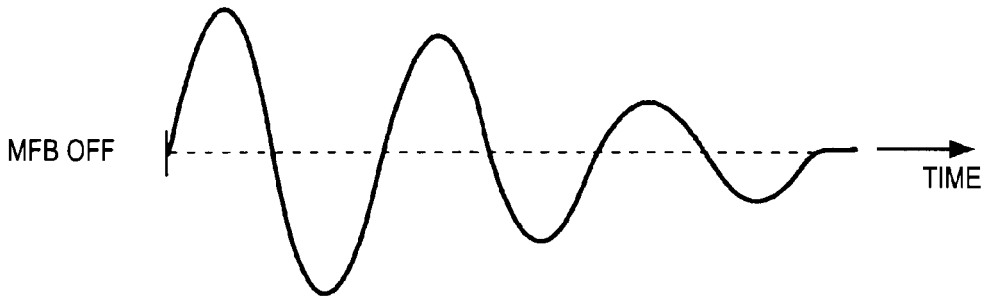
FIGS. 7A to 7C are diagrams illustrating differences of sounds corresponding to each MFB operation mode based on transient phenomena.
Figure 7B:
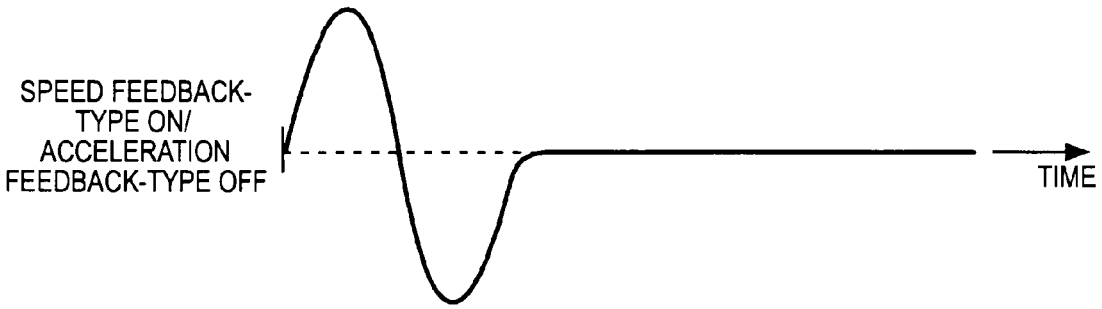
Figure 7C:
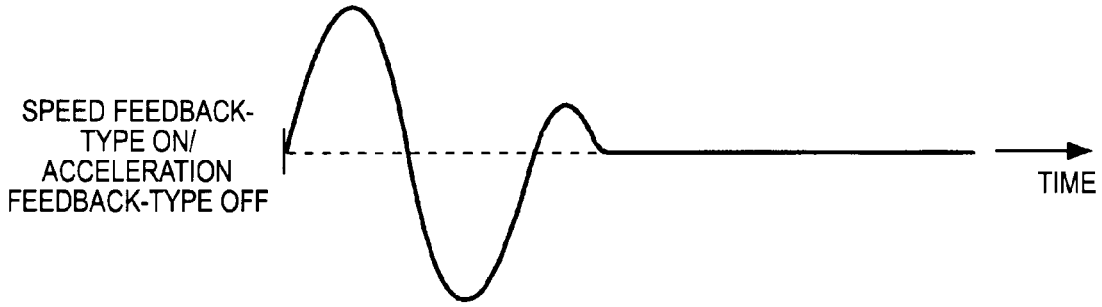

For example, the differences are as shown in FIGS. 7A to 7C in a case where the differences in the braking states of the diaphragm of the speaker unit 16 are viewed as transient phenomena. FIGS. 7A to 7C are schematic diagrams only for easy understanding of differences in the transient phenomena for each operation mode.

FIG. 7A shows the characteristic of the case of the MFB-Off mode corresponding to FIG. 3, FIG. 7B shows the characteristic of the case of the first MFB-On mode corresponding to FIG. 4, and FIG. 7C shows the characteristic of the case of the second MFB-On mode corresponding to FIG. 5. These diagrams can be regarded as measurements of the movements (near the low band resonant frequency f0) of the diaphragm, for example, right after supply of a driving signal to the speaker unit 16 is stopped at time 0.

In the case of the MFB-Off mode, damping due to the MFB is not effective. Thus, as shown in FIG. 7A, a characteristic in which the amplitude is slowly attenuated after elapse of time 0 is formed.

On the other hand, in the first MFB-On mode shown in FIG. 7B, damping is applied based on the MFB of the speed feedback type. Thus, the amplitude is attenuated in a time, which is shorter than that shown in FIG. 7A, from time 0. This indicates that the vibration pattern of the sound, for example, so-called "boomy base" is suppressed so as to be enhanced.

In addition, in the second MFB-On mode shown in FIG. 7C, the amplitude is attenuated in a short time from time 0. However, an image in which the time for attenuation of the amplitude is slightly lengthened, compared to the case of FIG. 7B, is formed. As one expression, this indicates that "boomy base" is suppressed same as in the case shown in FIG. 7B, and a hearing pattern in which slight reverberation remains is formed compared to the case shown in FIG. 7B.

Although the frequency characteristics are corrected to be the same in the first MFB-On mode and the second MFB-On mode as described above, there are differences between aural impressions and the hearing patterns of the sounds reproduced in the speaker unit 16.

A difference between the hearing patterns of the first MFB-On mode and the second MFB-On mode does not indicate that one mode is absolutely better than the other mode. Thus, the difference can be regarded to indicate that any one mode is desirable depending on the audience's taste. In addition, for the same audience, a mode thought to be desirable may be changed in accordance with the type of the sound source to be reproduced such as a genre.

In this viewpoint, an application for switching between the first MFB-On mode and the second MFB-On mode in accordance with a user's operation can be considered in a case where the MFB signal processing system is configured by digital circuits.

In other words, in addition to the change in the on/off state of the MFB, an operation for arbitrarily selecting the first MFB-On mode or the second MFB-On mode to be switched to can be performed depending on the taste of the sound in accordance with turning on the MFB.

In accordance with an operation of switching between operation modes of the MFB, data of a mode setting table shown in FIG. 8 is stored, for example, by the digital signal processing unit 10.

In the mode setting table shown in FIG. 8, first, the item of the operation mode out of the MFB-Off mode, the first MFB-On mode, and the second MFB-On mode is defined. As an operation of the MFB, any one of such operation modes can be selected. Then, the content of on/off setting of the speed feedback-type MFB, the content of on/off setting of the acceleration feedback-type MFB, and an equalizer correction characteristic to be set in the low frequency-band correction equalizer 12 are associated with each operation mode.

In FIG. 8, in correspondence with the MFB-Off mode, the speed feedback-type MFB to be turned off and the acceleration feedback-type MFB to be turned off are represented. In addition, regarding the equalizer correction characteristic, the low frequency-band correction equalizer 12 is represented to be passed through.

On the other hand, in correspondence with the first MFB-On mode, the speed feedback-type MFB to be turned on and the acceleration feedback-type MFB to be turned off are represented. In addition, "characteristic 1" is written in the figure as the equalizer correction characteristic. However, actually, the target frequency of which the characteristic is to be changed and parameters such as a gain at the target frequency, of which the characteristic is to be changed, are designated as the correction characteristic (equalizing characteristic), for example, for flattening the frequency characteristic.

On the other hand, the speed feedback-type MFB to be turned on and the acceleration feedback-type MFB to be turned on are represented. Regarding the equalizer correction characteristic written as "characteristic 2", parameters of the correction characteristic for flattening the frequency characteristic in correspondence with the second MFB-On mode are designated.

Here, it is assumed that the MFB-Off mode is selected by a user's operation. Accordingly, the digital signal processing unit 10, for example, as a DSP recognizes the content of setting on/off of the speed feedback-type MFB, the content of setting on/off of the acceleration feedback-type MFB, and the equalizer correction characteristic that are associated with the MFB-Off mode with reference to the mode setting table shown in FIG. 8. Then, the signal processing system is set such that the speed feedback-type MFB is turned off, the acceleration feedback-type is turned off, and the low frequency-band correction equalizer 12 is to be passed through. As a result, the digital signal processing system of the MFB-Off mode is formed.

On the other hand, in correspondence with selection of the first MFB-On mode, the digital signal processing unit 10 forms the signal processing system in accordance with the content of setting on/off of the speed feedback-type MFB, the content of setting on/off of the acceleration feedback MFB, and the equalizer correction characteristic that are associated with the first MFB-On mode in the mode setting table. In other words, in the digital signal processing unit 10, a closed loop is formed such that the speed feedback-type MFB is turned on, and the acceleration feedback-type MFB is turned off, and parameters represented by "characteristic 1" are set in the low frequency-band correction equalizer 12.

On the other hand, in correspondence with selection of the second MFB-On mode, the digital signal processing unit 10 forms the signal processing system in accordance with the content of setting on/off of the speed feedback-type MFB, the content of setting on/off of the acceleration feedback MFB, and the equalizer correction characteristic that are associated with the second MFB-On mode in the mode setting table. In other words, in the digital signal processing unit 10, a closed loop is formed such that both the speed feedback-type MFB and the acceleration feedback-type MFB are turned on, and parameters represented by "characteristic 2" are set in the low frequency-band correction equalizer 12.

3-4. Application Example (Second Example)

In the application of the first example corresponding to the mode setting table shown in FIG. 8, it is premised that the gain values (feedback gain values) set in the gain control sections 21 and 24 for the first MFB-On mode and the second MFB-On mode are fixed to be unique.

However, the parameter of the gain value of the gain control sections 21 and 24 included in the digital signal processing unit 10, which is a digital circuit, can be changed to be set in an easy manner. For example, by setting the gain of each of the gain control sections 21 and 24 for the operation mode in which both the speed feedback-type MFB and the acceleration feedback-type MFB are turned on, the feedback amount of the speed feedback-type MFB and the feedback amount of the acceleration feedback-type MFB can be appropriated changed to be set. Accordingly, as each feedback amount of the speed feedback-type MFB or the acceleration feedback-type MFB is changed, the hearing pattern of the sound reproduced in the speaker unit 16 changes in accordance with a combination of the feedback amounts of the speed feedback-type MFB and the acceleration feedback-type MFB. In addition, the hearing pattern of the sound according to the combination of the feedback amounts of the speed feedback-type MFB and the acceleration feedback-type MFB can be set more delicately, for example, compared to the case where a combination of on/off of the speed feedback-type MFB and on/off of the acceleration feedback-type MFB is used, which is the same as that in the application of the first example.

For example, even in a case where the same audio source is used, an appropriate acoustic tone is different for the sound of a video content such as a movie and for an audio content such as a CD. For example, in order to acquire vigor, there may be reverberation of a specific degree in the sound of a movie or the like. On the other hand, since reproduction with more fidelity may be needed for the sound of an audio content, it is preferable that reverberation of a level that is the same as that of the sound of a movie does not remain. In addition, a desired acoustic tone of an audio content is considered to be different, for example, depending on the genre of music or the like.

In consideration of the above-described situations, the second example of the application is configured as follows.

First, combinations of the feedback amounts of the speed feedback-type MFB and the acceleration feedback-type MFB, that is, the gain values to be set in the gain control sections 21 and 24, for which the acoustic tone appropriate for the content type of an audio source to be reproduced such as a movie or music or for the genre of the audio content is acquired, are determined in advance.

Then, based on the content of the determination, a gain-to-correction characteristic table, for example, as shown in FIG. 9 is generated, and the gain-to-correction characteristic table is stored in the digital signal processing unit 10.

As shown in FIG. 9, first, items are basically classified into content types of movie and music. In addition, the content type of the music is divided based on genres such as rock, jazz, and classic. In addition, each item of the movie, the rock, the jazz, and the classic is associated with the gain of the speed feedback-type MFB, the gain of the acceleration feedback-type MFB, and the equalizer correction characteristic.

As the gain of the speed feedback-type MFB, a gain value to be set in the gain control section 21 corresponding to the speed feedback-type MFB is represented. Here, the gain values to be set in the gain control section 21 in correspondence with each item of movie, rock, jazz, and classic are represented as a1, b1, c1, and d1.

Similarly, as the gain of the acceleration feedback-type MFB, the gain values to be set in the gain control section 24 corresponding to the acceleration feedback-type MFB are represented. Here, the gain values to be set in the gain control section 24 in correspondence with each item of movie, rock, jazz, and classic are represented as a2, b2, c2, and d2.

Accordingly, when the combination of the feedback amount of the speed feedback-type MFB and the feedback amount of the acceleration feedback-type MFB, that is, the gain values (feedback gain values) is changed, the frequency characteristic of the sound reproduced in the speaker unit 16 that is acquired based on the combination changes. Accordingly, in order to correct the frequency characteristic to be flat by using the low frequency-band correction equalizer 12, for example, as described above, the equalizer correction characteristic may need to be set in correspondence with the frequency characteristic acquired based on the combination of the gain values. The equalizer correction characteristic arranged in the gain-to-correction characteristic table shown in FIG. 9 represents the equalizing characteristic of the low frequency-band correction equalizer 12 that is set in correspondence with the frequency characteristic corresponding to each combination of gain values of the items.

The user is allowed to perform an operation of selecting the content type and the genre. When being in correspondence with the content of the table data shown in FIG. 9, one from four selection items of "movie" and "rock", "jazz", and "classic" of the content type of the music can be selected as the operation.

Then, in correspondence with selection of the content type and the genre that is made by the user's operation, the digital signal processing unit 10 acquires the gain of the speed feedback-type MFB, the gain of the acceleration feedback-type MFB, and the equalizer correction characteristic that are associated with the selected content type or genre from the gain-to-correction characteristic table. Then, the digital signal processing unit 10 changes the gain values of the gain control sections 21 and 24 and the equalizing characteristic of the low frequency-band correction equalizer 12 to be set in accordance with the acquired content.

As described above, in the application of the second example, the effective state of the MFB, which is appropriate for the selected content type and genre, is automatically set in correspondence with user's selection of the content type and the genre of the audio source to be reproduced to for designation. In other words, the effective state of the MFB is changed in order to acquire the acoustic tone of a reproduced sound appropriate for the content type and the genre of the audio source that is designated by the user.

The content types and the genres shown in FIG. 9 are only an example. In addition, in the application of the second example, it has been described that both the speed feedback-type MFB and the acceleration feedback-type MFB are turned on, and the gain value (feedback amount) for each content type and genre is changed to be set in the description of the application of the second example. However, also in the second example, a combination of on/off of the speed feedback-type MFB and the acceleration feedback-type MFB may be combinedly used. For example, a setting in which only the speed feedback-type MFB is turned on, and the gain value of that case is changed can be used.

In addition, also in the application of the first example described above, for example, a user interface according to the second example may be considered to be used for the selection operation, for example, of the MFB-Off mode, the first MFB-On mode, and the second MFB-On mode. In other words, for example, an expression representing the acoustic tone or a name of the genre, the content type, or the like is assigned to each selection item of the MFB-Off mode, the first MFB-On mode and the second MFB-On mode.

In addition, in the description until now, the equalizer correction characteristic of the low frequency-band correction equalizer 12 is assumed to be a flat characteristic as the target frequency characteristic. However, this is only an example. As long as a good result can be acquired aurally, as a target frequency characteristic other than the flat characteristic, an arbitrary characteristic such as a characteristic in which a low frequency-band is boosted to a specific level or cut may be set.

In addition, the target frequency characteristic may not need to be common to the operation modes of the MFB or the combinations of the feedback amounts. For example, in order to acquire a more desirable acoustic tone, different frequency characteristics may be intentionally set for the operation modes of the MFB or the combinations of the feedback amounts.

4. Digital MFB: Modified Example

Until now, configurations according to the embodiments in which the bridge detection method is basically used, and the speed feedback-type MFB and the acceleration feedback-type MFB are combinedly used have been described.

According to the bridge detection method, a counter electromotive force is detected by the bridge circuit 17. Thus, the advantages of the bridge detection method that a physical sensor does not need to be disposed, for example, in a diaphragm of the speaker unit 16 or the like, and the physical structure thereof is not complicated have been known.

However, as a detection method used for the MFB, a method in which the displacement of the diaphragm of the speaker unit 16 is detected, for example, by using a static capacitor, a laser displacement system, or the like other than the bridge detection method has been known.

Figure 10:
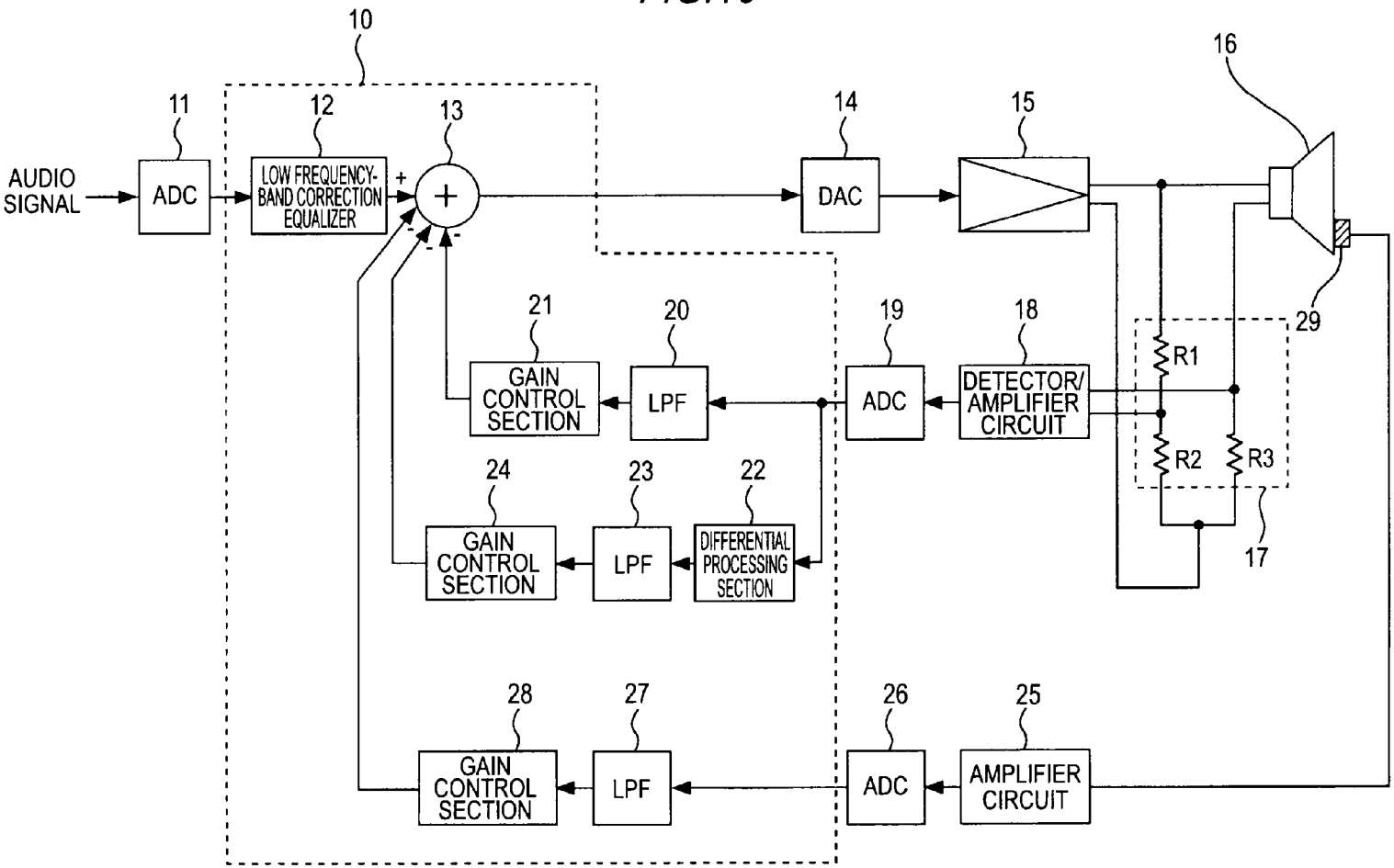
FIG. 10 is a diagram showing a configuration example of an MFB signal processing system according to a modified example of the embodiment.

Thus, as a modified example of the MFB signal processing system of this embodiment, a configuration example in which displacement detection is added to the configuration shown in FIG. 2 is shown in FIG. 10. In FIG. 10, a same reference sign is assigned to each same portion as that of FIG. 2, and the description thereof is omitted here.

As shown in FIG. 10, first, a displacement sensor 29 that is used for detecting the displacement of the diaphragm of the speaker unit 16 is disposed. This displacement sensor 29, for example, is configured by the static capacitor, the laser displacement system, or the like. An analog detection signal that is acquired by detecting the displacement of the diaphragm in the displacement sensor 29 is amplified by an amplifier circuit 25 and is converted into a digital signal by an ADC 26 so as to be input to a digital signal processing unit 10.

The digital signal processing unit 10 of this case further includes an LPF 27 and a gain control section 28. By allowing the digital displacement detection signal input from the ADC 26 to pass through the LPF 27, an unnecessary high frequency band component is eliminated, and a gain is applied by the gain control section 28. Then, a resultant signal is output to the synthesizer 13 as a feedback signal.

The synthesizer 13 of this case can invert a feedback signal corresponding to the speed feedback type that is output from the gain control section 21, a feedback signal corresponding to the acceleration feedback type that is output from the gain control section 24, and a feedback signal corresponding to the displacement detecting method (it can be regarded as a displacement feedback method as a feedback method) that is output from the gate control section 28 and combine the audio signal passing through the low frequency-band correction equalizer 12 with the inverted feedback signals.

Under such a configuration, in the application of the first example, a combination of on/off of the speed feedback-type MFB, the acceleration feedback-type MFB, and the MFB that is performed based on detection of displacement is changed, and the correction characteristic of the low frequency-band correction equalizer 12 is also changed to be set in accordance with the combination.

In addition, in correspondence with the application of the second example, a combination of gain values of the gain control sections 21, 24, and 28 is determined in accordance with the content type and the genre that are defined in advance, and the gain-to-correction characteristic table is formed based on the combination of the gain values and the equalizer correction characteristic determined in accordance with each combination.

As described above, as this embodiment, the number of MFB detection methods combinedly used and the pattern of the combination of the detection methods are not particularly limited.

In addition, even when a same detection method and same feedback method are used, the configuration for detection, the configuration for signal processing, and the like may be appropriately changed. As an example, as speed detection corresponding to the speed feedback-type MFB, for example, a technique for disposing a detection coil in the speaker unit 16 has been also known. In addition, a signal of speed detection can be acquired by detecting the acceleration and calculating the integration of the signal. Furthermore, for the acceleration detection, an acceleration sensor may be used, or detection of acoustic pressure by using a microphone may be employed.

5. Adjustment of Feedback Gain 5-1. Adjustment in Analog Circuit

The gain value of the feedback gain of the MFB signal processing system is set, for example, such that a desired feedback amount is acquired. However, although the same gain value is set, the feedback amounts actually acquired are different due to variations in the characteristics of the speaker units, variations in analog components such as portions for detecting movement of the diaphragm, and the like. Thus, in order to absorb the above-described variations and actually acquire an appropriate feedback amount, it is preferable to adjust the feedback gain, for example, in at least a stage prior shipment of the products from the factory to users.

Figure 19:
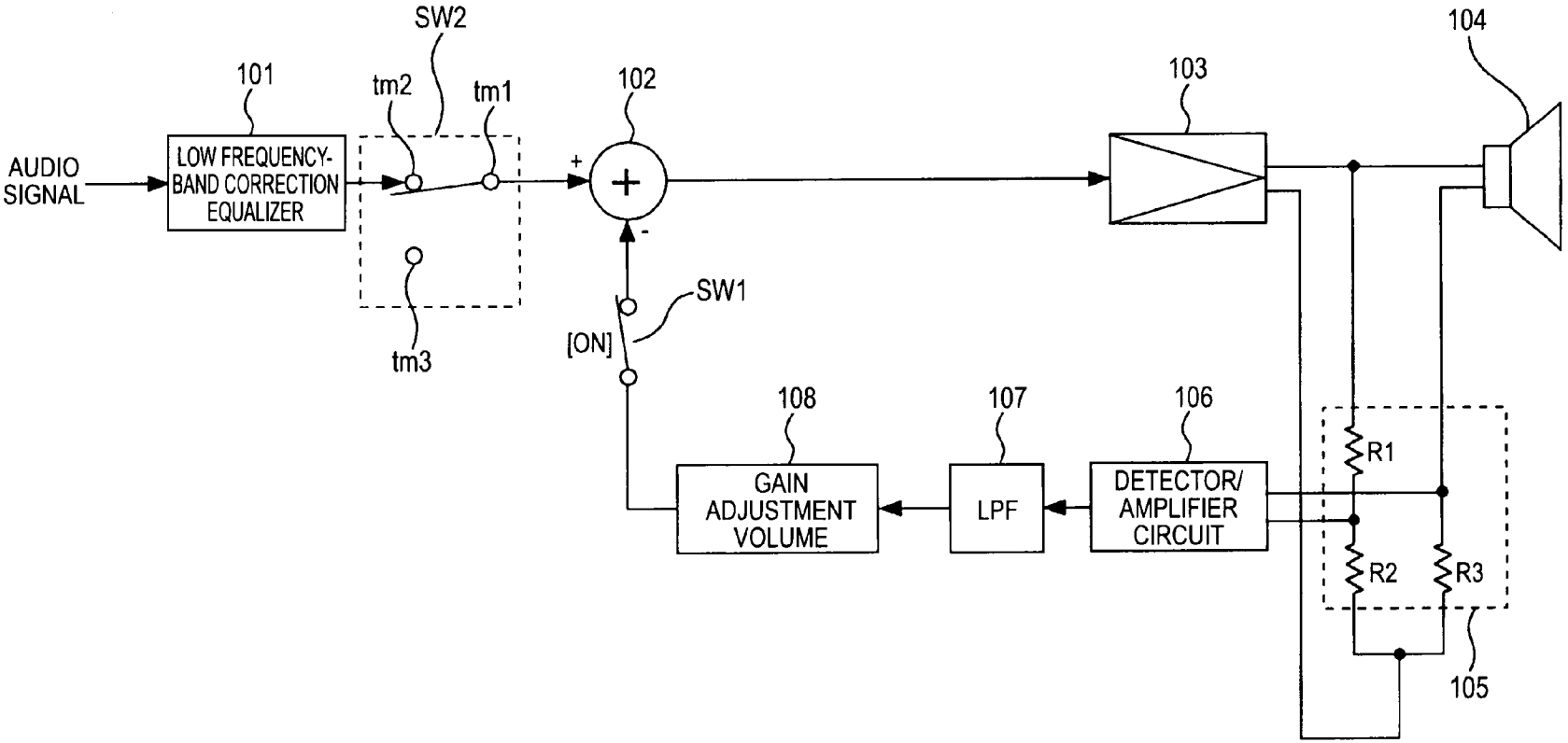
FIG. 19 is a diagram showing a configuration example of an analog MFB signal processing system in which the feedback gain can be adjusted.

Thus, first, a configuration example of an MFB signal processing system using analog circuits in which the feedback gain can be adjusted is shown in FIG. 19. The configuration shown in FIG. 19 has the configuration shown in FIG. 15 as its base. Thus, a same reference sign is assigned to each same portion as that shown in FIG. 15, and the description thereof is omitted.

As shown in FIG. 19, a switch SW1 is inserted between the output of the gain adjustment volume 108 and the input of the synthesizer 102. In addition, a switch SW2 is inserted between the output of the low frequency-band correction equalizer 101 and the input of the synthesizer 102. The switch SW1 is an on/off switch, and the switch SW2 is a change-over switch that changes connection of a terminal tm1 to any one of terminals tm2 and tm3. The terminal tm1 of the switch SW2 is connected to the input of the synthesizer 102, and the terminal tm2 of the switch SW2 is connected to the output of the low frequency-band correction equalizer 101. In addition, the terminal tm3 is open in correspondence with a normal operation.

In the normal operation, as shown in FIG. 19, the switch SW1 is turned on, and the terminal tm1 is connected to the terminal tm2 in the switch SW2. Accordingly, as an MFB signal processing system, a closed loop circuit as shown in FIG. 1 is formed, and an input audio signal is output to the synthesizer 102 through the low frequency-band correction equalizer 12. In other words, a circuit is formed that can perform normal signal processing of the MFB.

Figure 20:
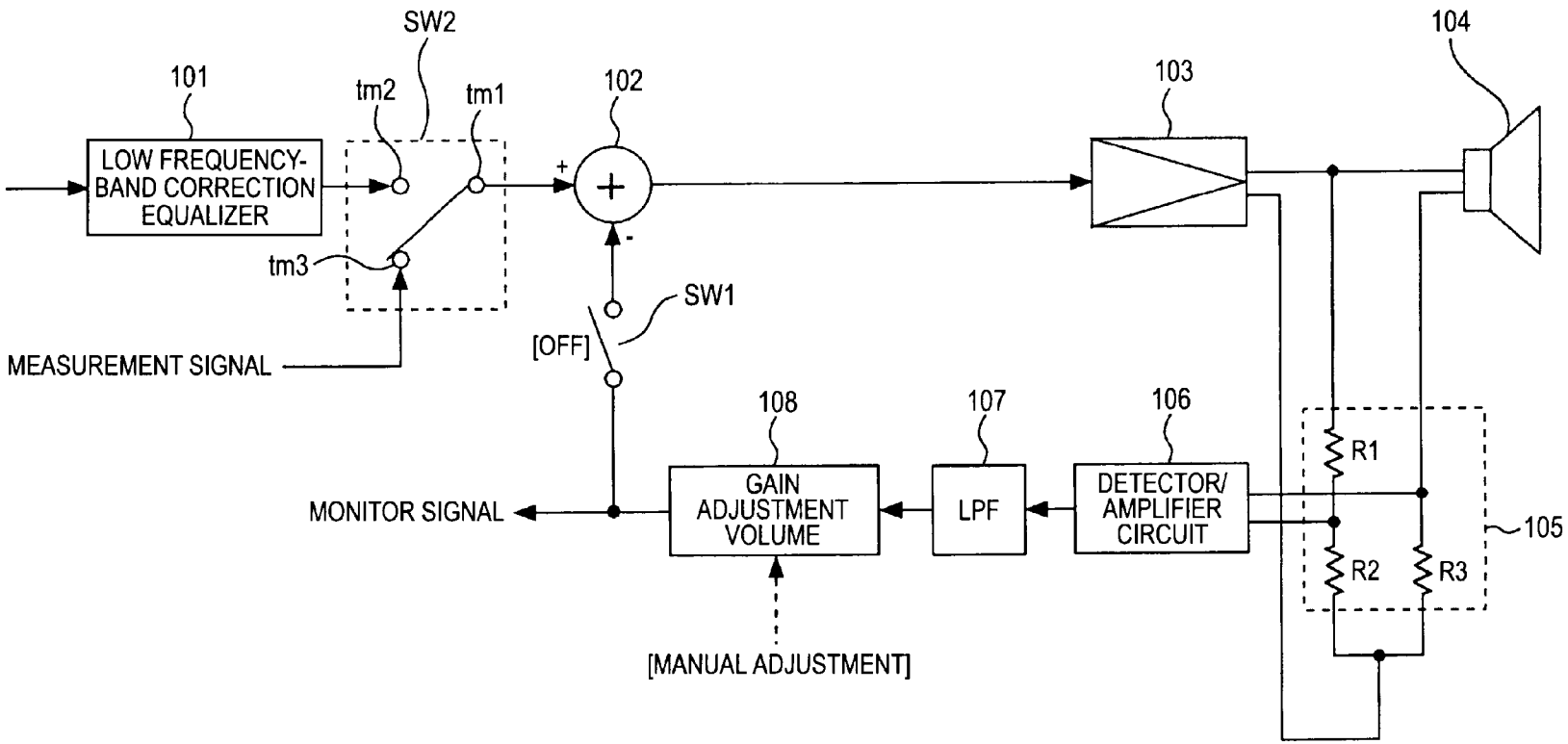
FIG. 20 is a diagram showing an example of a circuit form, which is formed in correspondence with adjustment of the feedback gain, in the MFB signal processing system shown in FIG. 19.

On the other hand, in order to adjust the feedback gain, as shown in FIG. 20, the switch SW1 is turned off. Accordingly, the output of the gain adjustment volume 108 is not input to the synthesizer 102, and thereby an open loop is formed. The switch SW2 is shifted so as to connect the terminal tm1 to the terminal tm3, and a measurement signal for feedback gain adjustment is input to the terminal tm3. Accordingly, the measurement signal instead of an audio signal of an audio source is input to the MFB signal processing system of the open loop.

In addition, as the measurement signal corresponding to the MFB signal processing system configured by analog circuits, for example, a sinusoidal sweep signal corresponding to a frequency band to be measured, white noise, or the like can be used.

In addition, the output of the gain adjustment volume 108 is input to a measurement monitoring device, for example, as a monitor signal.

In the configuration shown in FIG. 20, the measurement signal input to the terminal tm3 of the switch SW2 is acquired as a monitor signal through the power amplifier 103, the speaker unit 104, the bridge circuit 105, the detector/amplifier circuit 106, the low pass filter 107, and the gain adjustment volume 108.

Figure 21:
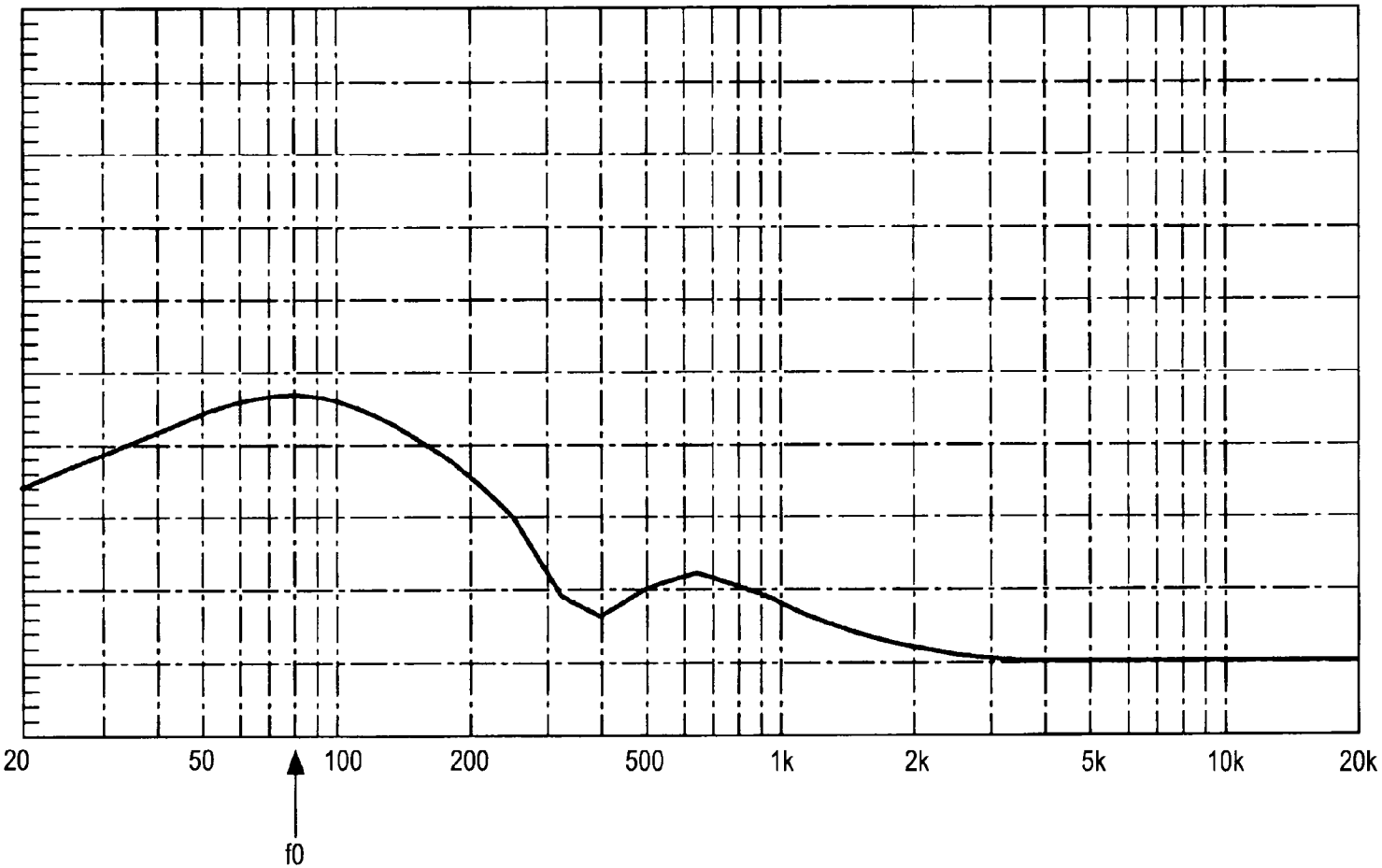
FIG. 21 is a frequency characteristic diagram for illustrating an example of the adjustment of the feedback gain in the circuit form shown in FIG. 20.

It is assumed that the frequency characteristic of the monitor signal is as shown FIG. 21 as a result of the measurement. Accordingly, the monitor signal has a characteristic in which a peak is acquired at the low band resonant frequency f0=80 Hz. As an example, here, the MFB signal processing system is assumed to apply feedback of 12 dB in the closed loop state. When the feedback amount (multiplication) of the closed loop is denoted by $\alpha$, the gain of the open loop is $\alpha-1$.

Thus, in this case, for example, an adjustment operator manually adjusts a variable resistance device as the gain adjustment volume 108, while observing the monitor signal, such that power of the peak at the low band resonant frequency f0 =80 Hz is three times the power (level) of the measurement signal.

As described above, for the case of the MFB signal processing system configured by analog circuits, the feedback gain may need to be manually adjusted. Accordingly, it is difficult to perform precise adjustment of the feedback gain for each device having the MFB signal processing system.

In addition, for the case of an analog circuit, for example, after adjustment of the feedback gain in a stage before shipment, the switches SW1 and SW2 are shifted from the state shown in FIG. 20 to the state shown in FIG. 19, and, for example, the device is assembled or the like and then is shipped. Accordingly, commonly, it is difficult to adjust the feedback gain in a stage in which the device is passed to a general user. In other words, generally, the adjustment of the feedback gain is limited to a manufacturing stage. Even when the device is configured such that the switches SW1 and SW2 and the variable resistance device of the gain adjustment volume can be operated in a simple manner by a general user, a measurement device and the like may be needed for the adjustment and corresponding technologies may be also needed. In other words, it is not preferable to allow a general user to be able to adjust the device.

5-2. Adjustment in Digital Circuit

Thus, as this embodiment, a configuration in which the feedback gain can be automatically adjusted is proposed as follows.

Figure 11:
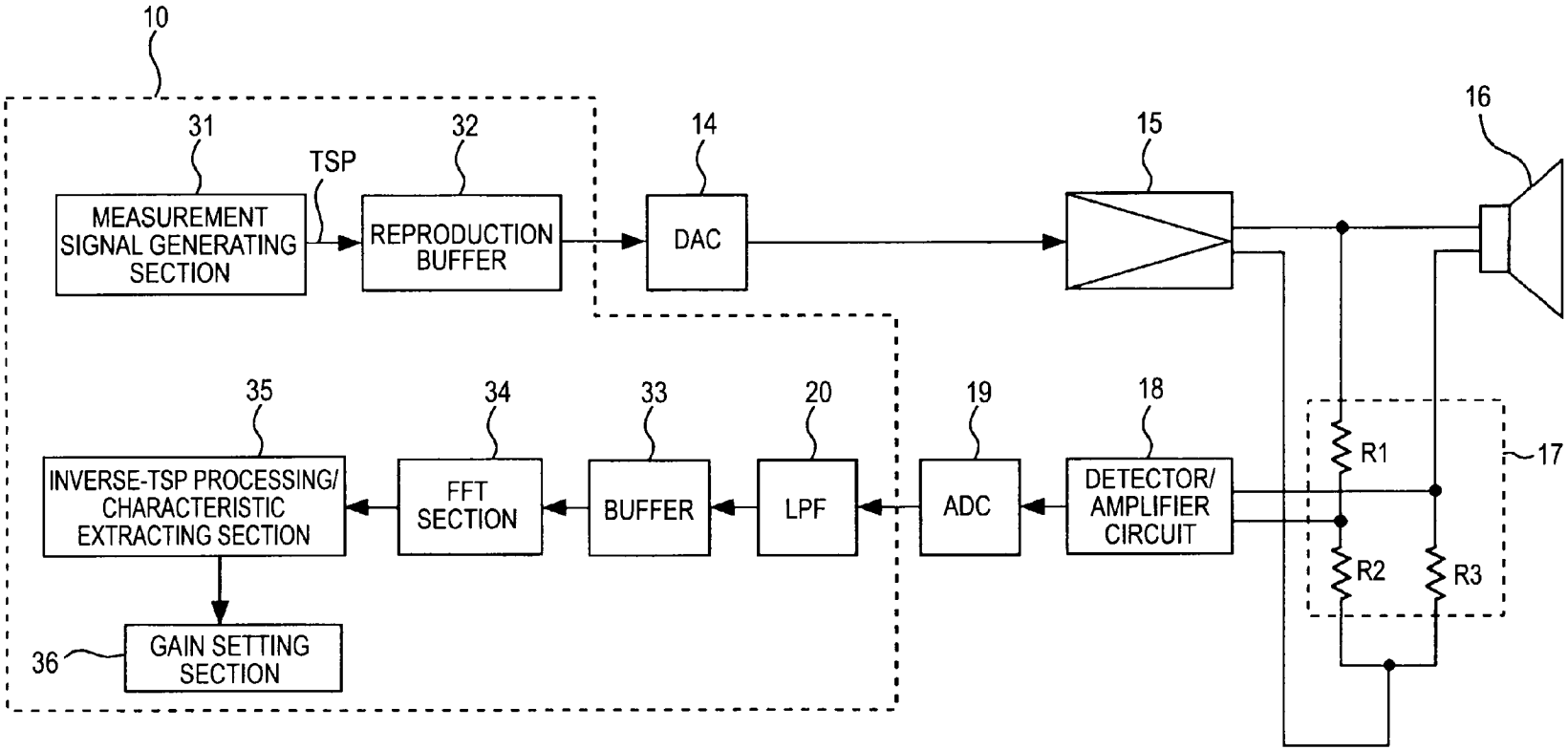
FIG. 11 is a diagram showing a configuration example of a digital signal processing unit, which is for setting feedback gain, according to an embodiment.

FIG. 11 shows a configuration example of an MFB signal processing system configured by digital circuits for adjusting the feedback gain, as an embodiment. In the figure, a same reference sign is assigned to a same portion as that shown in FIGS. 1 and 2, and the description thereof is omitted. As this embodiment, as shown in FIG. 2 and the like, a configuration in which a plurality of feedback control systems having different feedback methods are included in a digital signal processing stage is used as its basic configuration. However, for easy understanding of the description, FIG. 11 shows a configuration example that is based on a configuration in which only one feedback control system of the speed feedback type shown in FIG. 1 is included.

Under the MFB signal processing system of this embodiment that is configured by digital circuits, in adjusting the feedback gain, the signal processing operation of the digital signal processing unit 10, for example, that is a DSP is formed as shown in FIG. 11. In other words, the digital signal processing unit 10 is configured to include a measurement signal generating section 31, a reproduction buffer 32, an LPF 20, a buffer 33, an FFT section 34, an inverse-TSP processing/characteristic extracting section 35, and a gain setting section 36.

The measurement signal generating section 31 of this case is a digital circuit and accordingly, for example, generates a TSP (Time Stretched Pulse) signal as a measurement signal. In other words, impulse response measurement is used for measurement performed for adjustment of the feedback gain here. The TSP signal that is generated by the measurement signal generating section 31 is stored in the reproduction buffer 32. First, data read out from the reproduction buffer 32 is set as a digital TSP signal and is output from the digital signal processing unit 10. This TSP signal is converted into an analog signal by the DAC 14 and is amplified by the power amplifier 15 so as to be supplied to the voice coil of the speaker unit 16. The movement of the diaphragm of the speaker unit 16 according to the TSP signal at this time is detected by the bridge circuit 17 and is output to an ADC 19 as an amplified detection signal from a detector/amplifier circuit 18. The ADC 19 converts the input analog detection signal into a digital detection signal and outputs the digital detection signal.

In the digital signal processing unit 10, by passing the digital detection signal output from the ADC 19 through the LPF 20, an unnecessary high frequency-band component is eliminated. The buffer 33 loads the TSP response signal that has passed through the LPF 20 a plurality of number of predetermined times, and for example, calculates an average value, and transmits the average value to the FFT section 34.

In the FFT section 34, a frequency analysis process, for example, by using a FFT (First Fourier Transform) is performed for the averaged TSP response signal. In addition, the inverse-TSP processing/characteristic extracting section 35 performs an inverse-TSP process for the data transmitted from the FFT section 34. Accordingly, in this case, as an MFB signal processing system of the open loop, the characteristic of a measurement signal transmitted through a system of the speed feedback type is acquired.

Thus, the gain setting section 36 sets the feedback gain based on a difference between the value of the peak level (the low band resonant frequency f0) that appears in the frequency characteristic measured by the inverse-TSP processing/characteristic extracting section 35 and the value of the target peak level. For example, in a case where the peak level represented by the frequency characteristic measured by the inverse-TSP processing/characteristic extracting section 35 is −5 dB, and the target peak level is 9 dB, the feedback gain is acquired as 9−(−5)=14 dB.

The MFB signal processing system shown in FIG. 11 is an open loop. It is difficult to perform measurement for setting the feedback gain unless the MFB signal processing system is the open loop. Accordingly, the feedback gain that is acquired in the stage until up to here has a value corresponding to the open loop. In a case where the MFB is actually applied by the MFB signal processing system, the closed loop shown in FIG. 1 is formed. However, the feedback gain that has the target peak level at this time, that is, the feedback gain at the time of the closed loop has an error with respect to that at the time of the open loop.

Thus, the gain setting section 36 acquires the feedback gain value at the time of the closed loop based on the feedback gain value at the time of the open loop acquired as described above. A concrete example of a calculation expression is omitted. However, the feedback gain value at the time of the closed loop can be uniquely acquired by calculation using the feedback gain value at the time of the open loop acquired as described above.

The digital signal processing unit 10 stores the feedback gain value at the time of the closed loop that is acquired by the gain setting section 36 as described above as a parameter to be set in the gain control section 21. Then, when the MFB signal processing system is actually operated, the digital signal processing unit 10 forms the signal processing system shown in FIG. 1, for example, in the case corresponding to FIG. 11. At that time, the stored feedback gain value is set in the gain control section 21.

As described above, in the feedback gain adjustment of this embodiment, an optimal value is automatically acquired. In addition, while measurement for the open loop is performed, the gain value corresponding to the time of the closed loop can be finally acquired.

In addition, the feedback gain to be automatically adjustable as described above can be rephrased that troubles as in the case of an analog circuit do not occur even when the feedback gain value is configured to be adjustable, for example, in accordance with a user's operation or the like.

Thus, a device having the MFB signal processing system of this embodiment is configured such that an operation for directing the adjustment of the feedback gain value can be performed as a user's operation. Then, in correspondence with the operation for directing the adjustment of the feedback gain value, the digital signal processing unit 10, first, forms the signal processing system of the open loop shown in FIG. 11, starts the measurement, finally acquires the feedback gain value at the time of the closed loop, and stores the acquired feedback gain value. Then, when the MFB signal processing system is operated thereafter, the feedback gain value that is newly stored is set in the gain control section 21.

For example, in accordance with a temporal change or the like, the reproduction characteristic of the speaker unit 16 or the characteristic of an analog component may change. When such a change in the characteristics occurs, there is an error, for example, between the gain value that has been set until now and a gain value that is actually optimal in accordance with the change. When the feedback gain value can be readjusted at arbitrary time in accordance with the user's operation as described above, the MFB can be operated by typically setting the feedback gain value to be optimal in accordance with the above-described temporal change.

In addition, actually, as shown in FIGS. 2 and 10, in a case where the configuration of the MFB signal processing system combining a plurality of feedback control systems is employed, the feedback gain value at the time of the closed loop for each system may be acquired.

As an example, in the case of a configuration corresponding to FIG. 2, the MFB signal processing system is formed by further adding an open loop of the acceleration feedback type to the configuration shown in FIG. 11. In other words, first, the differential processing section 22 and the LPF 23 that are shown in FIG. 2 are arranged in the digital signal processing unit 10. Even in such a case, a digital detection signal output from the ADC 19 may be branched and input to the differential processing section 22. In addition, in the latter stage of the LPF 23, a system corresponding to the acceleration feedback type which is formed by a buffer 33, an FFT section 34, an inverse-TSP processing/characteristic extracting section 35, and a gain setting section 36 is arranged in parallel with the system of the speed feedback type shown in FIG. 11. Accordingly, the gain value to be set in the gain control section 24 in correspondence with the acceleration feedback type is acquired together with a gain value to be set in the gain control section 21 in correspondence with the speed feedback type.

In addition, in a case where the configuration in which the gain value is changed in correspondence with each item of the content type or the genre, like the MFB control corresponding to the table data shown in FIG. 9, is used, the feedback gain value is acquired in correspondence with each item. In this case, for the signal processing systems having the same combination of the feedback methods to be turned on, the feedback gain value corresponding to one signal processing system, which becomes a base among them, is acquired by being measured. Next, a method may be considered in which, for example, offset amounts, offset ratios, or the like with respect to the basic feedback gain value are set for the other signal processing systems, and each feedback gain value is acquired by calculation.

6. Adjustment of Correction Characteristic of Equalizer 6-1. Adjustment in Analog Circuit In the case where the feedback gain value can be adjusted as described above, even when the feedback gain value is changed, the frequency characteristic of the reproduced sound of the speaker unit 16 is changed without changing the equalizing characteristic. Thus, the correction characteristic (equalizing characteristic) of the low frequency-band correction equalizer 12 also may need to be set again in correspondence with the feedback gain value after adjustment.

Thus, for example, for the MFB signal processing system configured by analog circuits that is shown in FIG. 1, the equalizing characteristic can be set as follows.

First, a microphone for receiving the sound reproduced in the speaker unit 16 is disposed, and the MFB signal processing system shown in FIG. 1 is operated in accordance with the closed loop in the state in which the characteristic of the low frequency-band correction equalizer 101 is set to a flat characteristic. In other words, the MFB is turned on. Then, in the state in which the MFB is turned on, the frequency band of the audio signal that is acquired by receiving the sound from the microphone is measured. An operator, for example, manually changes the equalizing characteristic of the low frequency-band correction equalizer 101, while monitoring the measured frequency characteristic, such that the measured frequency characteristic is the target frequency characteristic.

As described above, the adjustment of the equalizing characteristic may need to be manually performed in the MFB signal processing system configured by analog circuits in the state in which the MFB is turned on, and accordingly, a measurement device may be needed. Accordingly, in a case where a general case is considered, the adjustment of the equalizing characteristic is performed in a manufacturing stage or a stage prior to shipment from the factory, and it is not appropriate to allow a user to adjust the equalizing characteristic.

6-2. Adjustment in Digital Circuit

Figure 12:
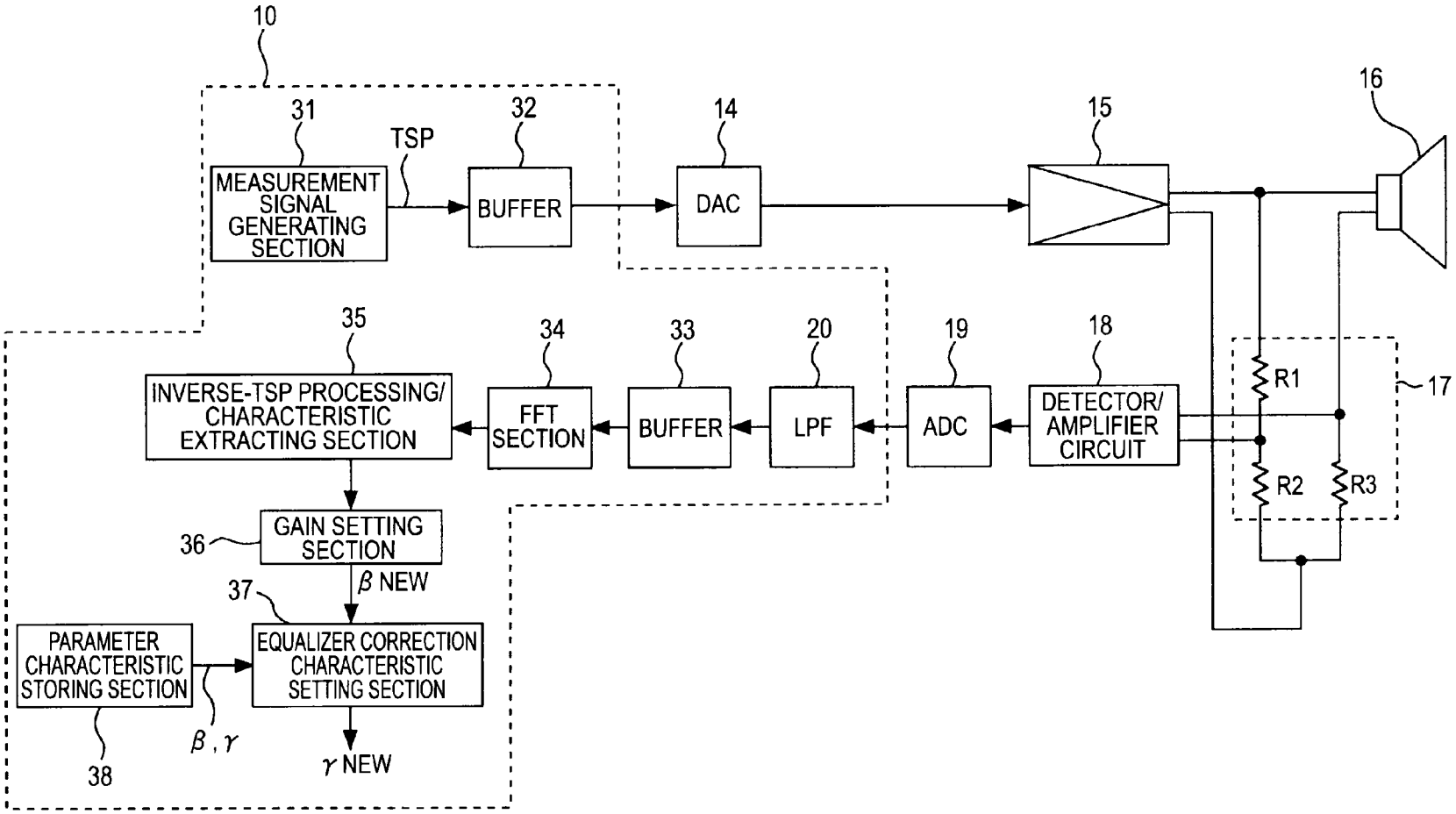
FIG. 12 is a diagram showing a configuration example of a digital signal processing unit, which is for setting an equalizer correction characteristic, according to an embodiment.

A configuration example for adjustment of the equalizing characteristic (equalizer correction characteristic) corresponding to this embodiment is shown in FIG. 12. Even in this case, for convenience of the description, a configuration on the premise that an MFB signal processing system configured only by one system of the speed feedback type is used is shown. In FIG. 12, a same reference sign is assigned to each same portion as that shown in FIG. 11, and the description thereof is omitted. The configuration shown in FIG. 12 is formed by adding an equalizer correction characteristic setting section 37 and a parameter storing section 38 to the configuration shown in FIG. 11. The parameter storing section 38 of this case stores the feedback gain value β at the time of the closed loop to be set in the gain control section 21 and an equalizer correction characteristic γ to be set in the low frequency-band correction equalizer 12 therein, as parameters.

The equalizer correction characteristic setting section 37 acquires a new equalizer correction characteristic γnew corresponding to a newly acquired feedback gain value βnew based on the feedback gain value βnew newly acquired by the gain setting section 36 and the feedback gain value β and the equalizer correction characteristic γ that are stored in the parameter storing section 38.

Figure 13:
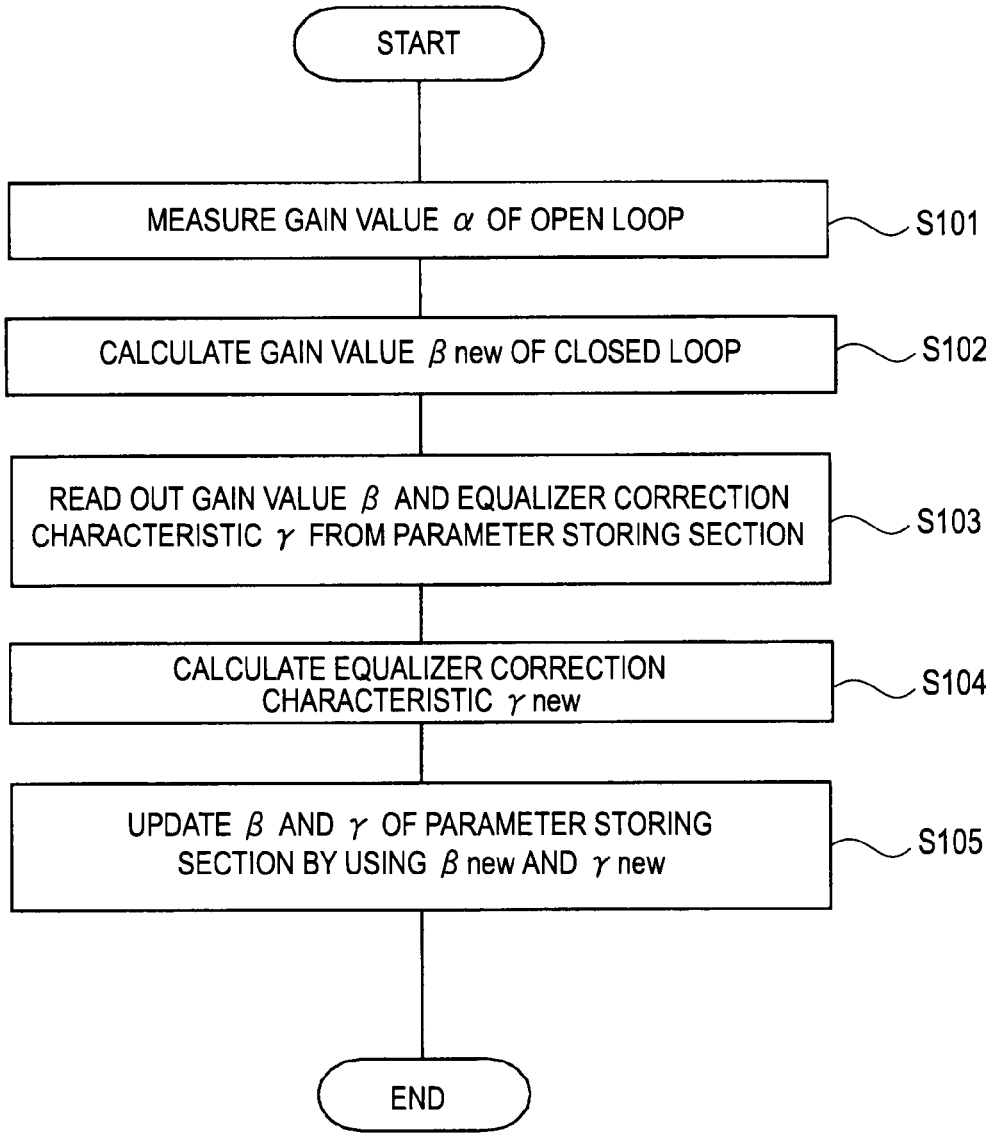
FIG. 13 is a flowchart representing an example of the process sequence for setting an equalizer correction characteristic based on the configuration shown in FIG. 12.

FIG. 13 represents a process for setting an equalizer correction characteristic that is performed by the digital signal processing unit 10 shown in FIG. 12 as a flowchart. In addition, steps represented in this figure, for example, can be regarded to be appropriately performed by either the gain setting section 36 or the equalizer correction characteristic setting section 37.

First, the gain setting section 36 measures a feedback gain value α corresponding to the time of the open loop in Step S101 and calculates a new feedback gain value βnew at the time of the new closed loop by calculation using the feedback gain value α in Step S102. The processes of the Steps S101 and S102 may be performed in the order described above with reference to FIG. 11.

Subsequently, in Step S103, the equalizer correction characteristic setting section 37 reads out the feedback gain value β and the equalizer correction characteristic γ, which are stored in the parameter storing section 38.

Next, in Step S104, the equalizer correction characteristic setting section 37 calculates a new equalizer correction characteristic γnew based on calculation using the feedback gain value β and the equalizer correction characteristic γ that are read out in Step S103 and the new feedback gain value βnew calculated in advance in Step S102.

The description of a concrete example of a calculation expression for calculating the equalizer correction characteristic γnew is omitted. However, as an algorithm for the calculation, for example, first, a difference between the new feedback gain value βnew and the feedback gain value β used until now is acquired. Next, an error of the frequency characteristic that is assumed to be generated, for example, in accordance with the acquired difference is acquired. When the error is acquired, the correction amount of the equalizer characteristic for compensating for the error is uniquely acquired. Then, by performing calculation for changing the equalizer correction characteristic γ used until now in correspondence with the correction amount, a new equalizer correction characteristic γnew is acquired.

Next, the equalizer correction characteristic setting section 37 sets the equalizer correction characteristic γnew that has been newly acquired as described above as the equalizer correction characteristic γ to be stored in the parameter storing section 38 thereafter in Step S105. Similarly, the equalizer correction characteristic setting section 37 sets the feedback gain value βnew, which has been acquired in Step S102, corresponding to the above-described equalizer correction characteristic γnew as the feedback gain value β to be stored in the parameter storing section 38 thereafter.

Accordingly, in this embodiment, the feedback gain value is newly set, and the equalizer correction characteristic corresponding to the feedback gain value that has been newly set can be set additionally. In other words, in addition to the feedback gain value, the equalizer correction characteristic can be automatically adjusted.

Similarly to FIGS. 2 and 10, in a case where a configuration of the MFB signal processing system combining a plurality of feedback control systems 1 to n is employed, first, as described above, the feedback gain values βnew(1) to βnew(n) at the time of the closed loop are acquired for each system. In addition, the equalizer correction characteristic setting section 37 performs calculation by using the new feedback gain values βnew(1) to βnew(n) acquired for each of the plurality of systems and the feedback gain values β(1) to β(n) stored in the parameter storing section 38. As a result of the calculation, the error in the frequency characteristic and the correction amount of the equalizer characteristic are acquired, and finally, the equalizer correction characteristic γnew is acquired.

In addition, regarding how to set the equalizer correction characteristic to be initially stored in a stage prior to shipment from the factory, for example, in order to precisely set in correspondence with the variations in each device, the following may be performed.

Figure 14:
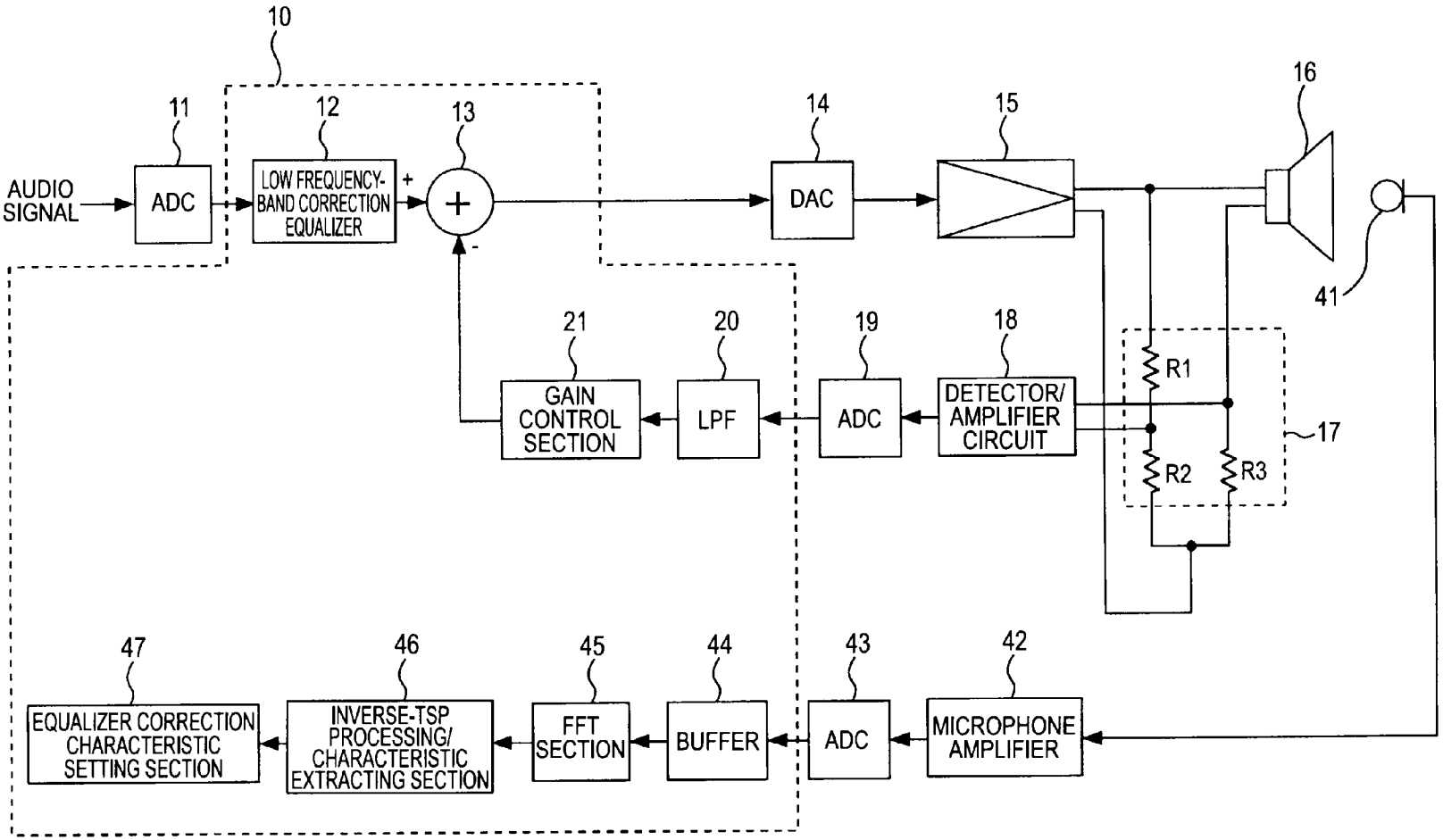
FIG. 14 is a diagram showing a configuration example for setting an initial equalizer correction characteristic at the time of factory shipment, according to an embodiment.

FIG. 14 shows a configuration example of an MFB signal processing system corresponding to adjustment of the initial equalizer correction characteristic. In the figure, the MFB signal processing system according to a closed loop, for example, that is the same as that shown in FIG. 2 is formed. In addition, on the outside of the digital signal processing unit 10, a microphone 41, a microphone amplifier 42, and an ADC 43 are added. Furthermore, the digital signal processing unit 10 additionally includes a buffer 44, an FFT section 45, an inverse-TSP processing/characteristic extracting section 46, and an equalizer correction characteristic setting section 47.

Then, in order to set the equalizer correction characteristic, first, a measurement signal is input to the ADC 11, and the MFB signal processing system is operated. At this time, the correction characteristic of the low frequency-band correction equalizer 12 is set to be a flat characteristic. In other words, the configuration is the same as that in which the low frequency-band correction equalizer 12 is passed through. In addition, the feedback gain value of the gain control section 21 is adjusted in advance.

The microphone 41 is arranged so as to receive the sound reproduced from the speaker unit 16. Accordingly, an audio signal according to the sound acquired by reproducing the measurement signal by using the speaker unit 16 can be acquired by the microphone 41. This audio signal is amplified, for example, by the microphone amplifier 42 and is converted into a digital signal by the ADC 43 so as to be input to the digital signal processing unit 10.

In the digital signal processing unit 10, bypassing the digital audio signal, of which the sound is received, through the buffer 44, the FFT processing section 45, and the inverse-TSP processing/characteristic extracting section 46, a process is performed which is equivalent to the process performed by the buffer 33, the FFT processing section 34, and the inverse-TSP processing/characteristic extracting section shown in FIG. 12. In other words, the frequency characteristic of the measured sound received by the microphone 41 can be acquired.

The equalizer correction characteristic setting section 47 acquires a correction amount for correcting the frequency characteristic acquired by the inverse-TSP processing/characteristic extracting section 35 to the target frequency characteristic. In other words, the equalizer correction characteristic setting section 47 acquires the equalizer correction characteristic $\gamma$. Then, the equalizer correction characteristic $\gamma$ acquired as described above is stored, for example, in the parameter storing section 38 shown in FIG. 12.

This embodiment is not limited to the configuration described until now.

For example, in the above-described configuration of the MFB signal processing system, a digital signal is converted into an analog signal by the DAC 14 and is amplified by the power amplifier 15 disposed in an analog stage so as to drive the speaker unit 16. However, for example, this portion may be configured by a D-class amplifier that receives a digital audio signal as input and drives the speaker unit or the like.

In addition, as described above, the feedback methods to be combined for the MFB, the types of a sensor, a circuit, or the like that detects the movement of the speaker diaphragm, the number of the feedback methods to be combined, and the like are not limited to the above-described configuration and may be appropriately changed.

The present application contains subject matter related to that disclosed in Japanese Priority Patent Application JP 2009-140968 filed in the Japan Patent Office on Jun. 12, 2009, the entire contents of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A signal processing apparatus comprising:

one or more detection means disposed for detecting movement of a diaphragm of a speaker in correspondence with first to n-th feedback methods that are different feedback methods;

analog-to-digital conversion means for converting one or more detection signals of an analog form acquired by the one or more detection means into a digital form;

feedback signal generating means for generating feedback signals corresponding to the first to n-th feedback methods by using the one or more detection signals of the digital form acquired by the analog-to-digital conversion means;

correction equalizer means for setting an equalizing characteristic to allow a sound reproduced by the speaker to have a target frequency characteristic by changing a frequency characteristic of an audio source signal of the digital form;

synthesis means for combining the audio source signal of the digital form, from the correction equalizer means, to be output as a driving signal of the speaker with the feedback signals;

feedback operation setting means for setting which of the first to n-th feedback methods in which a feedback operation up to combining the audio source signal with the feedback signal, which is performed by the synthesis means, is performed and which of the first to n-th feedback methods in which the feedback operation is not performed; and equalizing characteristic changing and setting means for changing the equalizing characteristic to be set by the correction equalizer means based on which of the first to n-th feedback methods is performed and which of the first to-nth feedback methods is not performed.

2. The signal processing apparatus according to claim 1, further comprising:

measurement signal generating means for generating a measurement signal in the digital form to be output as the driving signal of the speaker;

frequency characteristic acquiring means for acquiring the frequency characteristic by receiving the detection signal for each feedback method which is detected so as to be acquired by the one or more detection means at a time when the measurement signal is supplied to the speaker as the driving signal and is converted into the digital form by the analog-to-digital conversion means; and gain adjusting means for acquiring a gain for each feedback method, which is to be set by gain control means, based on the frequency characteristic of the detection signal for each feedback method that is acquired by the frequency characteristic acquiring means, wherein the feedback signal generating means includes the gain control means for applying the gain to the corresponding feedback signal for each feedback signal corresponding to the first to n-th feedback methods.

3. The signal processing apparatus according to claim 2, further comprising:

equalizing characteristic adjusting means for acquiring the equalizing characteristic for each new feedback method corresponding to a time when a new gain is set by the gain control means based on at least the gain for each new feedback method, which is acquired by the gain adjusting means, and the gain for each feedback method set until the gain for each new feedback method is acquired.

4. The signal processing apparatus according to claim 2, wherein the gain adjusting means, first, acquires a gain at the time of an open loop, in which the feedback signal is not combined by the synthesis means, based on the frequency characteristic of the detection signal that is acquired by the frequency characteristic acquiring means and acquires a gain at the time of a closed loop in which the feedback signal is combined by the synthesis means as the gain for each feedback method that is set by the gain control means by calculation using the gain at the time of the open loop.

5. The signal processing apparatus according to claim 3, wherein the gain adjusting means, first, acquires a gain at the time of an open loop, in which the feedback signal is not combined by the synthesis means, based on the frequency characteristic of the detection signal that is acquired by the frequency characteristic acquiring means and acquires a gain at the time of a closed loop in which the feedback signal is combined by the synthesis means as the gain for each feedback method that is set by the gain control means by calculation using the gain at the time of the open loop.

6. The signal processing apparatus according to claim 2, further comprising:

gain changing and setting means for changing and setting the gain applied to each feedback signal by the gain control means, wherein the equalizing characteristic changing and setting means changes the equalizing characteristic to be set by the correction equalizer means in accordance with the changing and setting of the gain applied to the feedback signal corresponding to the feedback method in which the feedback operation is performed.

7. The signal processing apparatus according to claim 3, further comprising:

gain changing and setting means for changing and setting the gain applied to each feedback signal by the gain control means, wherein the equalizing characteristic changing and setting means changes the equalizing characteristic to be set by the correction equalizer means in accordance with the changing and setting of the gain applied to the feedback signal corresponding to the feedback method in which the feedback operation is performed.

8. The signal processing apparatus according to claim 4, further comprising:

gain changing and setting means for changing and setting the gain applied to each feedback signal by the gain control means, wherein the equalizing characteristic changing and setting means changes the equalizing characteristic to be set by the correction equalizer means in accordance with the changing and setting of the gain applied to the feedback signal corresponding to the feedback method in which the feedback operation is performed.

9. The signal processing apparatus according to claim 5, further comprising:

gain changing and setting means for changing and setting the gain applied to each feedback signal by the gain control means, wherein the equalizing characteristic changing and setting means changes the equalizing characteristic to be set by the correction equalizer means in accordance with the changing and setting of the gain applied to the feedback signal corresponding to the feedback method in which the feedback operation is performed.

10. A signal processing method comprising the steps of:

converting one or more detection signals of an analog form acquired by one or more detecting units, which are disposed to detect movement of a diaphragm of a speaker in correspondence with first to n-th feedback methods that are different feedback methods, into a digital form;

generating feedback signals corresponding to the first to n-th feedback methods by using the detection signals of the digital form acquired in the converting of one or more detection signals into a digital form;

setting, by a correction equalizing unit, an equalizing characteristic to allow a sound reproduced by the speaker to have a target frequency characteristic by changing a frequency characteristic of an audio source signal of the digital form;

combining the audio source signal of the digital form, from the correction equalizing unit, to be output as a driving signal of the speaker with the feedback signals;

setting which of the first to n-th feedback methods in which a feedback operation up to combining the audio source signal with the feedback signal, which is performed in the combining of the audio source signal with the feedback signal, is performed and which of the first to n-th feedback methods in which the feedback operation is not performed; and changing the equalizing characteristic to be set in the setting of an equalizing characteristic based on which of the first to n-th feedback methods is performed and which of the first to-nth feedback methods is not performed.

11. A signal processing apparatus comprising:

one or more detection units disposed to detect movement of a diaphragm of a speaker in correspondence with first to n-th feedback methods that are different feedback methods;

an analog-to-digital conversion unit configured to convert one or more detection signals of an analog form acquired by the one or more detection units into a digital form;

a feedback signal generating unit configured to generate feedback signals corresponding to the first to n-th feedback methods by using the one or more detection signals of the digital form acquired by the analog-to-digital conversion unit;

a correction equalizer unit configured to set an equalizing characteristic to allow a sound reproduced by the speaker to have a target frequency characteristic by changing a frequency characteristic of an audio source signal of the digital form;

a synthesis unit configured to combine the audio source signal of the digital form, from the correction equalizer unit, to be output as a driving signal of the speaker with the feedback signals;

a feedback operation setting unit configured to set which of the first to n-th feedback methods in which a feedback operation up to combining the audio source signal with the feedback signal, which is performed by the synthesis unit, is performed and which of the first to n-th feedback methods in which the feedback operation is not performed; and an equalizing characteristic changing and setting unit configured to change the equalizing characteristic to be set by the correction equalizer unit based on which of the first to n-th feedback methods is performed and which of the first to-nth feedback methods is not performed.

12. The signal processing apparatus according to claim 11, wherein the equalizing characteristic changing and setting unit changes the equalizing characteristic to be set by the correction equalizer unit based on a determination of which of the first to n-th feedback methods is performed and which of the first to-nth feedback methods is not performed.

* * * * *